US011472146B2

(12) United States Patent
Stanley et al.

(10) Patent No.: US 11,472,146 B2
(45) Date of Patent: Oct. 18, 2022

(54) FLEXIBLE CONTAINERS HAVING IMPROVED SEAM AND METHODS OF MAKING THE SAME

(71) Applicant: The Procter & Gamble Company, Cincinnati, OH (US)

(72) Inventors: Scott Kendyl Stanley, Mason, OH (US); Charles John Berg, Jr., Wyoming, OH (US); Kenneth Stephen McGuire, Montgomery, OH (US); Lee Mathew Arent, Fairfield, OH (US); Benjamin Jacob Clare, Cincinnati, OH (US); Marc Richard Bourgeois, Liberty Township, OH (US); Tadayoshi Ishihara, West Chester, OH (US); Joseph Craig Lester, Liberty Township, OH (US); Andrew Paul Rapach, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 498 days.

(21) Appl. No.: 15/652,340

(22) Filed: Jul. 18, 2017

(65) Prior Publication Data

US 2017/0313495 A1 Nov. 2, 2017

Related U.S. Application Data

(63) Continuation of application No. 14/448,440, filed on Jul. 31, 2014, now Pat. No. 9,731,889.
(Continued)

(51) Int. Cl.
*B31B 70/00* (2017.01)
*B31B 70/62* (2017.01)
(Continued)

(52) U.S. Cl.
CPC ..... *B31B 70/00* (2017.08); *B31B 70/001* (2017.08); *B31B 70/62* (2017.08); *B31B 70/81* (2017.08);
(Continued)

(58) Field of Classification Search
CPC .. B65D 83/0055; B65D 11/22; B65D 75/008; B05B 11/00412; B31B 70/00;
(Continued)

(56) References Cited

U.S. PATENT DOCUMENTS 3,006,396 A 10/1961 Cushman
3,171,559 A 3/1965 Ferree
(Continued)

FOREIGN PATENT DOCUMENTS

CN 1162293 A 10/1997
CN 1640777 7/2005
(Continued)

OTHER PUBLICATIONS

U.S. Appl. No. 29/526,409, filed May 8, 2015, McGuire et al.
(Continued)

*Primary Examiner* — Sameh Tawfik
(74) *Attorney, Agent, or Firm* — James E Oehlenschlager

(57) ABSTRACT

A non-durable flexible container can include a first film wall including a first portion comprising at least one first structural support member defined in the first film wall, and a second portion that is free of a structural support member. The container can further include a second film wall including at least one second structural support member defined in the second film wall, wherein at least a portion of the first structural support member is adjacent to at least a portion of the second structural support member to define a seam region, and a side of the seam region defines an edge of the non-durable flexible container. The container can also
(Continued)

include a closed produce volume defined between first and second film walls; and a seam projecting outwardly from the seam region at an intersection of the first and second film walls.

9 Claims, 30 Drawing Sheets

Related U.S. Application Data

(60) Provisional application No. 61/861,106, filed on Aug. 1, 2013.

(51) Int. Cl.

| | |
|---|---|
| ***B31B 70/81*** | (2017.01) |
| ***B65D 83/00*** | (2006.01) |
| *B05B 11/00* | (2006.01) |
| *B65D 6/34* | (2006.01) |
| *B65D 75/00* | (2006.01) |

(52) U.S. Cl.
CPC .... *B65D 83/0055* (2013.01); *B05B 11/00412* (2018.08); *B65D 11/22* (2013.01); *B65D 75/008* (2013.01)

(58) Field of Classification Search
CPC ..... B31B 70/001; B31B 70/62; B31B 70/81; B31B 70/84; B31B 2105/00
USPC ..... 493/83
See application file for complete search history.

(56) References Cited

U.S. PATENT DOCUMENTS 3,191,849 A * 6/1965 Gutowski ..... B65D 75/30 383/119
3,730,240 A 5/1973 Presnick
3,742,994 A 7/1973 Pensak
3,930,286 A 1/1976 Mcgowen
3,975,885 A 8/1976 Carlisle
4,044,867 A 8/1977 Fisher
4,189,456 A 2/1980 Rausing
4,211,596 A * 7/1980 Lustig ..... A22C 13/0013 156/244.12
4,216,639 A 8/1980 Gautier
4,240,556 A * 12/1980 Field ..... B65D 81/03 206/522
4,361,235 A 11/1982 Gautier
4,384,603 A 5/1983 Tyrer et al.
4,503,558 A 3/1985 Lief et al.
4,615,926 A 10/1986 Hsu et al.
4,700,531 A 10/1987 Hsu et al.
4,700,871 A 10/1987 Matsuo et al.
4,704,314 A 11/1987 Hsu et al.
4,854,481 A 8/1989 Bohl et al.
4,898,306 A 2/1990 Pardes
4,918,904 A 4/1990 Pharo
4,949,530 A 8/1990 Pharo
4,978,025 A 12/1990 Fougeres
4,988,016 A 1/1991 Hawkins et al.
4,997,107 A 3/1991 Snyder et al.
5,074,300 A 12/1991 Murphy
5,137,154 A * 8/1992 Cohen ..... B65D 33/00 206/522
5,140,801 A 8/1992 Wild
5,170,609 A 12/1992 Bullock et al.
5,174,458 A 12/1992 Segati
5,261,881 A 11/1993 Riner
5,263,587 A 11/1993 Elkin et al.
5,267,646 A 12/1993 Inoue et al.
5,427,830 A 6/1995 Pharo
5,469,966 A 11/1995 Boyer
5,489,464 A 2/1996 Bjoerck
5,622,283 A 4/1997 Morrison
5,692,833 A 12/1997 Deluca
5,788,121 A 8/1998 Sasaki et al.
5,791,485 A * 8/1998 Carbonneau ..... B65D 31/02 206/204
5,823,391 A 10/1998 Klauke et al.
5,880,241 A 3/1999 Brookhart et al.
5,950,833 A 9/1999 James
5,960,975 A 10/1999 Lenartsson
5,971,208 A 10/1999 Kennedy
6,007,246 A 12/1999 Kinigakis et al.
6,015,235 A 1/2000 Kraimer et al.
6,176,613 B1 1/2001 Chen
6,206,569 B1 3/2001 Kraimer et al.
6,244,441 B1 6/2001 Ahlgren
6,244,466 B1 6/2001 Naslund
6,398,029 B1 6/2002 Farison et al.
6,471,402 B1 10/2002 Burns
6,488,146 B1 12/2002 Dotsikas
6,520,332 B1 2/2003 Barmore
6,520,491 B2 2/2003 Timlick
6,581,972 B2 6/2003 Nojima et al.
6,607,097 B2 8/2003 Savage et al.
6,619,505 B1 9/2003 Decottignies et al.
6,673,301 B2 1/2004 Cargile et al.
6,682,825 B1 1/2004 Kennedy et al.
6,913,803 B2 7/2005 Peper
6,921,201 B2 7/2005 Richardson, Jr. et al.
6,978,893 B2 12/2005 Peper
6,982,113 B2 1/2006 Kannankeril et al.
7,021,505 B2 4/2006 Franczyk
7,056,593 B2 6/2006 Kennedy et al.
7,168,566 B2 1/2007 Anderson et al.
7,168,567 B2 1/2007 Peper et al.
7,207,717 B2 7/2007 Steele
7,344,038 B2 3/2008 Elansary
7,494,279 B2 2/2009 Marquet et al.
7,585,528 B2 9/2009 Ferri et al.
7,722,254 B2 5/2010 Murray
7,819,582 B2 10/2010 Rosen
7,883,268 B2 2/2011 Steele
8,028,502 B2 10/2011 Murray
8,181,428 B2 5/2012 Gustafsson
8,206,033 B2 6/2012 Sato et al.
8,336,790 B2 12/2012 Kolins
8,464,499 B2 6/2013 Asp et al.
8,500,330 B2 8/2013 Nomura et al.
8,540,094 B2 9/2013 Riedl
8,661,772 B2 3/2014 Yasuhira
8,662,751 B2 3/2014 Forss
8,910,834 B2 12/2014 Becker et al.
8,960,183 B2 2/2015 Husson, Jr.
9,327,867 B2 5/2016 Stanley et al.
9,365,339 B2 * 6/2016 Perell ..... B29C 66/1122
9,469,088 B2 10/2016 Stanley et al.
9,499,322 B2 * 11/2016 Araki ..... B65D 75/008
9,586,744 B2 3/2017 Arent et al.
9,694,942 B2 7/2017 Stanley et al.
2003/0094394 A1 5/2003 Anderson et al.
2003/0094395 A1 5/2003 Peper et al.
2003/0096068 A1 5/2003 Peper
2003/0161999 A1 8/2003 Kannankeril et al.
2003/0192909 A1 10/2003 Maskell
2004/0035865 A1 2/2004 Rosen
2004/0079764 A1 4/2004 Balz et al.
2004/0216429 A1 11/2004 Tanaka et al.
2005/0126941 A1 * 6/2005 Ferri ..... B65D 75/52 206/323
2005/0152624 A1 * 7/2005 Versluys ..... B29C 44/1271 383/107
2005/0263426 A1 * 12/2005 Ho ..... B65D 81/02 206/522
2006/0021996 A1 2/2006 Scott, III et al.
2006/0030471 A1 2/2006 Schaller et al.
2006/0113269 A1 6/2006 Etesse et al.
2006/0165939 A1 7/2006 Hottner
2006/0210773 A1 9/2006 Kannankeril
2007/0003170 A1 * 1/2007 Yoshida ..... B65D 81/075 383/3

(56) References Cited

U.S. PATENT DOCUMENTS

| | | | |
|---|---|---|---|
| 2007/0045342 | A1 | 3/2007 | Pigliacampo et al. |
| 2007/0047851 | A1 | 3/2007 | Sato et al. |
| 2007/0068118 | A1 | 3/2007 | Forss |
| 2007/0084745 | A1 | 4/2007 | Yoshifusa |
| 2007/0092164 | A1 | 4/2007 | Yasuhira |
| 2007/0102316 | A1 | 5/2007 | Van Der Krogt et al. |
| 2007/0181598 | A1 | 8/2007 | Cremeans et al. |
| 2007/0267378 | A1 | 11/2007 | Piccinino et al. |
| 2008/0149666 | A1 | 6/2008 | Laflamme et al. |
| 2008/0193055 | A1 | 8/2008 | Chen et al. |
| 2008/0193057 | A1 | 8/2008 | Nomura et al. |
| 2008/0230424 | A1 | 9/2008 | Chawla et al. |
| 2008/0245804 | A1 | 10/2008 | Weinberger |
| 2008/0277310 | A1 | 11/2008 | Chacon |
| 2008/0298724 | A1 | 12/2008 | Liao et al. |
| 2009/0057347 | A1 | 3/2009 | Leys et al. |
| 2009/0307945 | A1 | 12/2009 | Bopp et al. |
| 2010/0061664 | A1 | 3/2010 | Gustafsson et al. |
| 2010/0155396 | A1 | 6/2010 | Warner |
| 2010/0308062 | A1 | 12/2010 | Helou |
| 2011/0039098 | A1 | 2/2011 | Forloni et al. |
| 2011/0062051 | A1 | 3/2011 | Miller |
| 2011/0079608 | A1 | 4/2011 | Mamiye |
| 2011/0290798 | A1 | 12/2011 | Corbett et al. |
| 2012/0033897 | A1 | 2/2012 | Lahr |
| 2012/0085782 | A1 | 4/2012 | Futori |
| 2012/0085785 | A1 | 4/2012 | Sand |
| 2012/0097634 | A1 | 4/2012 | Riedl |
| 2012/0125947 | A1 | 5/2012 | Becker et al. |
| 2012/0187069 | A1 | 7/2012 | Harris et al. |
| 2013/0015204 | A1 | 1/2013 | Gol |
| 2013/0167481 | A1 | 7/2013 | Jidoki |
| 2013/0292287 | A1* | 11/2013 | Stanley ..... B65D 85/00 206/459.5 |
| 2013/0292353 | A1 | 11/2013 | Stanley et al. |
| 2013/0292395 | A1 | 11/2013 | Stanley et al. |
| 2013/0292413 | A1 | 11/2013 | Stanley et al. |
| 2013/0292415 | A1 | 11/2013 | Stanley et al. |
| 2013/0294711 | A1 | 11/2013 | Stanley et al. |
| 2013/0337244 | A1 | 12/2013 | Stanley et al. |
| 2014/0033654 | A1 | 2/2014 | Stanley et al. |
| 2014/0033655 | A1 | 2/2014 | Stanley et al. |
| 2014/0250834 | A1 | 9/2014 | Yoshikane et al. |
| 2015/0028057 | A1 | 1/2015 | Arent et al. |
| 2015/0033671 | A1 | 2/2015 | Stanley et al. |
| 2015/0034662 | A1 | 2/2015 | Stanley et al. |
| 2015/0034670 | A1 | 2/2015 | Stanley et al. |
| 2015/0036950 | A1 | 2/2015 | Stanley et al. |
| 2015/0121810 | A1 | 5/2015 | Bourgeois et al. |
| 2015/0122373 | A1 | 5/2015 | Bourgeois et al. |
| 2015/0122840 | A1 | 5/2015 | Cox et al. |
| 2015/0122841 | A1 | 5/2015 | McGuire et al. |
| 2015/0122842 | A1 | 5/2015 | Berg et al. |
| 2015/0122846 | A1 | 5/2015 | Stanley et al. |
| 2015/0125099 | A1 | 5/2015 | Ishihara et al. |
| 2015/0125574 | A1 | 5/2015 | Arent et al. |
| 2015/0126349 | A1 | 5/2015 | Ishihara et al. |
| 2016/0176578 | A1 | 6/2016 | Stanley et al. |
| 2016/0176582 | A1 | 6/2016 | McGuire et al. |
| 2016/0176583 | A1 | 6/2016 | Ishihara et al. |
| 2016/0176584 | A1 | 6/2016 | Ishihara et al. |
| 2016/0176597 | A1 | 6/2016 | Ishihara et al. |
| 2016/0221727 | A1 | 8/2016 | Stanley et al. |
| 2016/0297569 | A1 | 10/2016 | Berg et al. |
| 2016/0297589 | A1 | 10/2016 | You et al. |
| 2016/0297590 | A1 | 10/2016 | You et al. |
| 2016/0297591 | A1 | 10/2016 | You et al. |
| 2016/0325518 | A1 | 11/2016 | Ishihara et al. |
| 2016/0362228 | A1 | 12/2016 | McGuire et al. |
| 2017/0001782 | A1 | 1/2017 | Arent et al. |
| 2017/0233116 | A1 | 8/2017 | Stanley |
| 2017/0305609 | A1 | 10/2017 | McGuire et al. |
| 2017/0305627 | A1 | 10/2017 | Aremt et al. |
| 2018/0079574 | A1 | 3/2018 | Ishihara |
| 2018/0236741 | A1 | 8/2018 | Hargett et al. |
| 2018/0237172 | A1 | 8/2018 | Lester et al. |
| 2018/0257836 | A1 | 9/2018 | McGuire et al. |
| 2018/0297725 | A1 | 10/2018 | Bourgeois et al. |
| 2018/0312283 | A1 | 11/2018 | Bourgeois et al. |
| 2018/0312286 | A1 | 11/2018 | Lester et al. |
| 2019/0352033 | A1 | 11/2019 | Lester |

FOREIGN PATENT DOCUMENTS

| | | | |
|---|---|---|---|
| CN | 201272533 | Y | 7/2009 |
| DE | 202005016704 | | 3/2006 |
| DE | 102005002301 | | 7/2006 |
| DE | 202010001261 | U1 | 5/2010 |
| EP | 0654418 | A1 | 5/1995 |
| EP | 0864508 | A1 | 9/1998 |
| EP | 1964785 | A2 | 9/2008 |
| EP | 2631195 | A1 | 8/2013 |
| FR | 2638715 | A1 | 5/1990 |
| FR | 2642727 | A2 | 8/1990 |
| FR | 2801287 | B1 | 4/2002 |
| JP | H07232744 | | 9/1995 |
| JP | A-H107159 | | 1/1998 |
| JP | H11342980 | A | 12/1999 |
| JP | 2000109095 | | 4/2000 |
| JP | 2001240138 | | 9/2001 |
| JP | 2001270533 | | 10/2001 |
| JP | 2002104431 | A | 4/2002 |
| JP | 2005059924 | A | 3/2005 |
| JP | 2005104468 | A | 4/2005 |
| JP | 2005153980 | A | 6/2005 |
| JP | 2005263260 | A | 9/2005 |
| JP | 2005343492 | | 12/2005 |
| JP | 2006027697 | | 2/2006 |
| JP | 2006044714 | A | 2/2006 |
| JP | 2006240651 | | 9/2006 |
| JP | 2009184690 | | 8/2009 |
| JP | 4639677 | | 2/2011 |
| JP | 2011037489 | A | 2/2011 |
| JP | 2011073717 | | 4/2011 |
| JP | 2012025394 | | 2/2012 |
| RU | 2038815 | | 7/1995 |
| TW | 252083 | B | 7/1995 |
| TW | 508335 | B | 11/2002 |
| WO | 9316928 | A1 | 9/1993 |
| WO | WO1996001775 | | 1/1996 |
| WO | 02085729 | A1 | 10/2002 |
| WO | 03051740 | A2 | 6/2003 |
| WO | WO2005063589 | | 7/2005 |
| WO | 2005108065 | A1 | 11/2005 |
| WO | WO2008064508 | | 6/2008 |
| WO | 2012062806 | A1 | 5/2012 |
| WO | WO2012073004 | | 6/2012 |
| WO | WO2013124201 | | 8/2013 |

OTHER PUBLICATIONS

U.S. Appl. No. 15/094,118, filed Apr. 8, 2016, Stanley et al.
U.S. Appl. No. 15/466,898, filed Mar. 27, 2017, Arent et al.
U.S. Appl. No. 15/466,901, filed Mar. 27, 2017, McGuire et al.
"The Rigidified Standing Pouch—A Concept For Flexible Packaging", Phillip John Campbell, A Thesis Written In Partial Fulfillment Of The Requirements For The Degree Of Master Of Industrial Design, North Carolina State University School Of Design Raleigh, 1993, pp. 1-35.
International Search Report and Written Opinion, PCT/US2014/049057, dated Oct. 7, 2014.
U.S. Appl. No. 63/185,931, B1, filed Nov. 20, 2001, Graphic Packaging Corporation.
All Office Actions, U.S. Appl. No. 13/888,679.
All Office Actions, U.S. Appl. No. 13/888,721.
All Office Actions, U.S. Appl. No. 13/888,963.
All Office Actions, U.S. Appl. No. 14/448,599.
PCT Search Report and Written Opinion for PCT/US2014/049056 dated Nov. 14, 2014, 9 pages.

* cited by examiner

FLEXIBLE CONTAINERS HAVING IMPROVED SEAM AND METHODS OF MAKING THE SAME

FIELD OF THE INVENTION

The present disclosure relates in general to containers, and in particular, to containers made from flexible material.

BACKGROUND OF THE INVENTION

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product volumes. A product volume can be configured to be filled with one or more fluent products. A container receives a fluent product when its product volume is filled. Once filled to a desired volume, a container can be configured to contain the fluent product in its product volume, until the fluent product is dispensed. A container contains a fluent product by providing a barrier around the fluent product. The barrier prevents the fluent product from escaping the product volume. The barrier can also protect the fluent product from the environment outside of the container. A filled product volume is typically closed off by a cap or a seal. A container can be configured to dispense one or more fluent products contained in its product volume(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

SUMMARY OF THE INVENTION

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure.

In accordance with an embodiment of the disclosure, a non-durable flexible container can include a first film wall including a first portion comprising at least one first structural support member defined in the first film wall, and a second portion that is free of a structural support member. The container can further include a second film wall including at least one second structural support member defined in the second film wall, wherein at least a portion of the first structural support member is adjacent to at least a portion of the second structural support member to define a seam region, and a side of the seam region defines an edge of the non-durable flexible container. The container can also include a closed product volume defined between first and second film walls; and a seam projecting outwardly from the seam region at an intersection of the first and second film walls.

In accordance with an embodiment of the disclosure, a non-durable flexible container can include a first film wall including a first portion including a first structural support volume defined in the first film wall, and a second portion that is free of a structural support volume. The container can further include a second film wall including a second structural support volume defined in the second film wall, at least a portion of one of the first and second structural support volumes overlying the other structural support volume to define a seam region. A side of the seam region defines an edge of the non-durable flexible container. The first and second film walls are integral with one another on at least one edge.

In accordance with an embodiment, a flexible material can include a plurality of container blanks. Each container blank can include a first film wall including a first portion including at least one first structural support member defined in the first film wall, and a second portion that is free of a structural support member, a second film wall including a second structural support member defined in the second film wall, and a seam outwardly projecting from an edge of a non-durable flexible container blank at an intersection of the first and second film walls, wherein adjacent container blanks share a seam on an edge.

In accordance with an embodiment, a method of making a non-durable flexible container can include providing a first flexible material comprising first and second sealable layers and providing a second flexible material comprising a third sealable layer. The method can further include joining a portion of the first sealable layer to a portion of the third sealable layer in a first region of the first and second flexible materials with at least one seal to define an inner boundary of a first structural support member, wherein the first structural support member is defined in a first portion of the first region and a second portion of the first region is free of a structural support member. The method can also include joining a portion of the first sealable layer to a portion of the third sealable layer in a second region of the first and second materials with at least one seal to define an inner boundary of the second structural support member. The method can include joining a portion of the second sealable layer in the first region and a portion of the second sealable layer in the second region with at least one seal to define an outer boundary of a product volume and a seam that outwardly projects from an edge of the non-durable flexible container.

DETAILED DESCRIPTION OF THE INVENTION

Figure 1A:
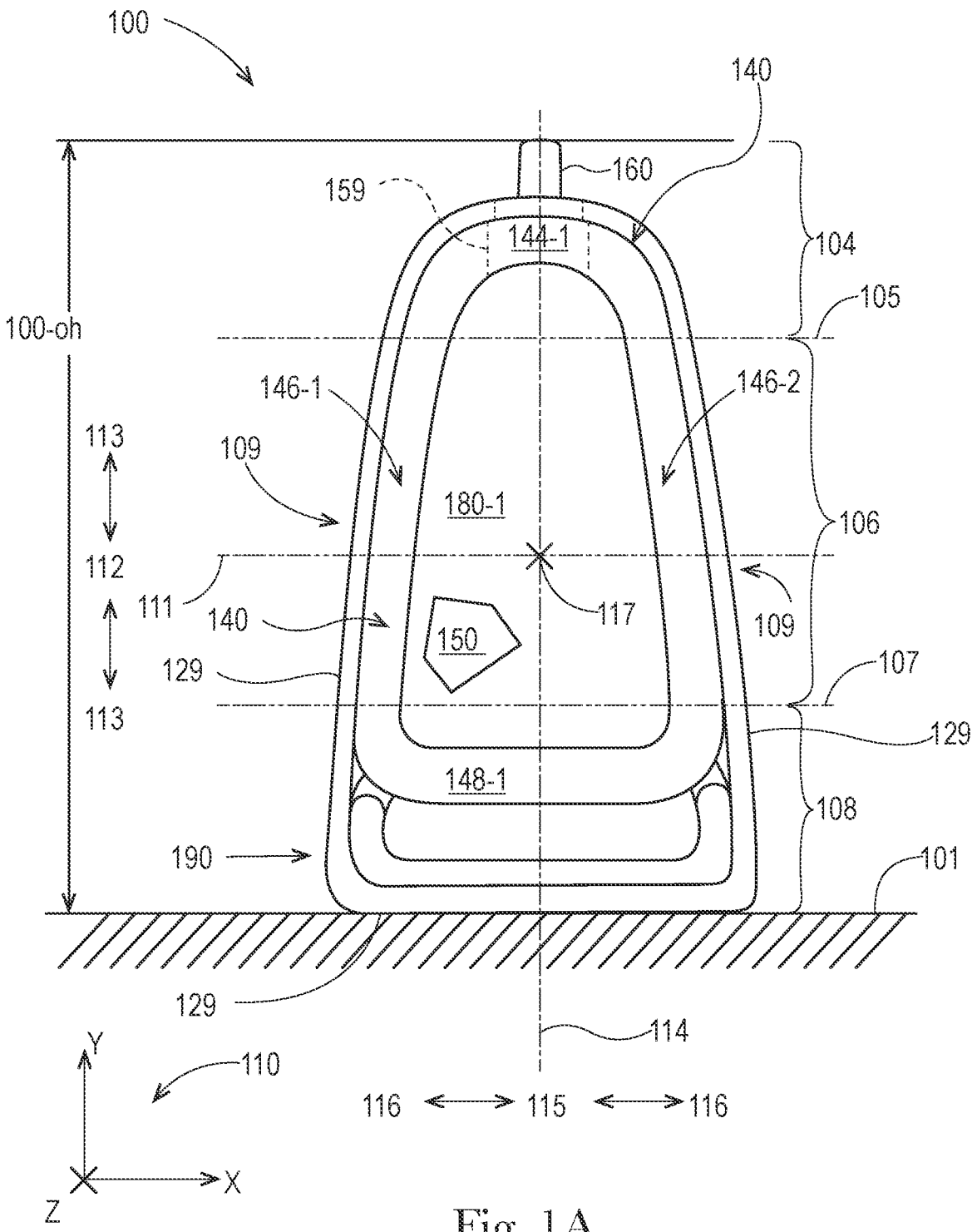
FIG. 1A illustrates a front view of an embodiment of a stand up flexible container.

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to decorate, because their flexible materials can be easily printed before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "ambient conditions" refers to a temperature within the range of 15-35 degrees Celsius and a relative humidity within the range of 35-75%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "closed" refers to a state of a product volume, wherein fluent products within the product volume are prevented from escaping the product volume (e.g. by one or more materials that form a barrier, and by a cap), but the product volume is not necessarily hermetically sealed. For example, a closed container can include a vent, which allows a head space in the container to be in fluid communication with air in the environment outside of the container.

As used herein, the term "cover material" refers to a material that is joined to at least a portion of the outer surface of the container. For example, the cover material can be joined to at least a portion of a structural support member and/or a nonstructural panel. The cover material can cover a portion or the entirety of the outer surface of the container. The cover material can be joined at the same position and/or at the same time as other existing seals and/or seams on the container. In some embodiments, the cover material can be joined after forming one or more seals and/or seams of the container. For example, in one embodiment, the cover material can be secured to a portion of the outer surface of the container to cover one or more seams projecting outwardly from the container. The cover material can be joined to at least a portion of the outer surface of the container using any suitable methods, including, for example, lamination, heat seal, adhesive, weld, attack, sew, and press-fit securement methods. The cover material can be any suitable flexible material including, for example, a film laminate, a non-woven, a vacuum-formed material, a hydro-formed material, a woven material, and a solid-state formed material. The cover material can have any suitable texture. In an embodiment, the cover material can have a different texture than the portions of the outer surfaces of the nonstructural panel and/or the one or more structural support volumes not covered by the cover material. Because such a cover material, or even a plurality of different-textured cover materials, may be selectively provided on various surfaces of the flexible container, such cover materials can provide a way for the manufacturer to vary tactile interaction at different locations of a given disposable flexible container. For example, in a gripping region of the container, the cover material can cover a seam projecting outwardly from the container, and present a smooth gripping surface. A container in accordance with the disclosure can include one or more cover materials joined to at least a portion of the outer surface of the container. In various embodiments, the container can be free of a cover material.

As used herein, "decorative embellishment" means the following elements: indicia, graphical elements, decorative etchings, ribbons, bows, printing, lacquers, optical coatings, soft touch coatings, decorative coatings, nonwoven substrates, woven substrates, textures, printable foams decorative inks and/or functional inks and combinations of these elements.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product volume to the environment outside of the container. For any of the flexible containers disclosed herein, any dispenser can be configured in any way disclosed herein or known in the art. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product volume(s) through one or more dispensers. In other alternate embodiments, a product volume can include one or filling structure(s) in addition to one or more dispenser(s).

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container (with all of its product volume(s) filled 100% with water) is standing upright and its bottom is resting on a horizontal support surface. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight lines segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product volume(s) are filled with fluent product(s), before or after the flexible container is shipped to a seller, and before or after the flexible container is purchased by an end user.

As used herein, when referring to a product volume of a flexible container, the term "filled" refers to the state when the product volume contains an amount of fluent product(s) that is equal to a full capacity for the product volume, with an allowance for head space, under ambient conditions. As used herein, the term filled can be modified by using the term filled with a particular percentage value, wherein 100% filled represents the maximum capacity of the product volume.

As used herein, the term "flat" refers to a surface that is without significant projections or depressions.

As used herein, the term "flexible container" refers to a container configured to have a product volume, wherein one or more flexible materials form 50-100% of the overall surface area of the one or more materials that define the three-dimensional space of the product volume. For any of the embodiments of flexible containers, disclosed herein, in various embodiments, the flexible container can be configured to have a product volume, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. In various embodiments, part, parts, or all of a flexible material can be coated or uncoated, treated or untreated, processed or unprocessed, in any manner known in the art. In various embodiments, parts, parts, or all of a flexible material can made of sustainable, bio-sourced, recycled, recyclable, and/or biodegradable material. Part, parts, or all of any of the flexible materials described herein can be partially or completely translucent, partially or completely transparent, or partially or completely opaque. The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, the term "gripping region" refers to a region of the container along which the users grasps the container to handle and/or dispense product from the container. The gripping region can include a portion of the edge of the container, as well as portions of the first and second walls of the container. The gripping region can overlap with a seam disposed along an edge of the container and/or can include one or more structural support members, about which a user must grab to handle and/or dispense product from the container. The gripping region may be in the top, middle, and/or bottom regions of the container in various embodiments. In various embodiments, the container can include multiple gripping regions.

As used herein, when referring to a flexible container, the term "height area ratio" refers to a ratio for the container, with units of per centimeter ($cm^{-1}$), which is equal to the value for the overall height of the container (with all of its product volume(s) filled 100% with water, and with overall height measured in centimeters) divided by the value for the effective base contact area of the container (with all of its product volume(s) filled 100% with water, and with effective base contact area measured in square centimeters). For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the term "indicia" refers to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright on a horizontal support surface, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with a differing first digit, wherein that first digit matches the number for its figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, when referring to a product volume, the term "multiple dose" refers to a product volume that is sized to contain a particular amount of product that is about equal to two or more units of typical consumption, application, or use by an end user. Any of the embodiments of flexible containers, disclosed herein, can be configured to have one or more multiple dose product volumes. A container with only one product volume, which is a multiple dose product volume, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "nonstructural panel" refers to a layer of one or more adjacent sheets of flexible material, the layer having an outermost major surface that faces outward, toward the environment outside of the flexible container, and an innermost major surface that faces inward, toward product volume(s) disposed within the flexible container; a nonstructural panel is configured such that, the layer, does not independently provide substantial support in making the container self-supporting and/or standing upright. In accordance with embodiments of the disclosure, the flexible container can include one or more nonstructural panels.

As used herein, when referring to a flexible container, the term "overall height" refers to a distance that is measured while the container is standing upright on a horizontal support surface, the distance measured vertically from the upper side of the support surface to a point on the top of the container, which is farthest away from the upper side of the support surface. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μm), or any integer value for micrometers from 5-500, or within any range formed by any of these values, such as 10-500 μm, 20-400 μm, 30-300 μm, 40-200 μm, or 50-100 μm, etc.

As used herein, the term "product volume" refers to an enclosable three-dimensional space that is configured to receive and directly contain one or more fluent product(s), wherein that space is defined by one or more materials that form a barrier that prevents the fluent product(s) from escaping the product volume. By directly containing the one or more fluent products, the fluent products come into contact with the materials that form the enclosable three-dimensional space; there is no intermediate material or container, which prevents such contact. Throughout the present disclosure the terms "product volume" and "product receiving volume" are used interchangeably and are intended to have the same meaning. Any of the embodiments of flexible containers, disclosed herein, can be configured to have any number of product volumes including one product volume, two product volumes, three product volumes, four product volumes, five product volumes, six product volumes, or even more product volumes. Any of the product volumes disclosed herein can have a product volume of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product volume can have any shape in any orientation. A product volume can be included in a container that has a structural support frame, and a product volume can be included in a container that does not have a structural support frame.

As used herein, when referring to a flexible container, the term "resting on a horizontal support surface" refers to the container resting directly on the horizontal support surface, without other support.

As used herein, the term "sealed," when referring to a product volume, refers to a state of the product volume wherein fluent products within the product volume are prevented from escaping the product volume (e.g. by one or more materials that form a barrier, and by a seal), and the product volume is hermetically sealed.

As used herein, the term "seam" refers to a joining of two or more flexible materials at an edge region of the container. In accordance with embodiments, a container can include a seam at least outwardly projecting from one or more edges of the container. In various embodiments portions of the seam can outwardly project from one or more edges of the container and different portions of the seam can inwardly project towards the one or more edges of the container. For example, a seam can be curled such that at a first lateral edge the seam projects outwardly and then curls such that a second lateral edge projects inwardly towards the edge of the container. One or more seams can also project internally into the product volume for some embodiments. A seam can extend along an entire length of an edge or only a portion of the length of the edge.

The seam has a seam width defined between two lateral edges of the seam. The first lateral edge of the seam is defined by at least a portion of the intersection of the first and second film walls. The second lateral edge of the seam is opposite the first lateral edge of the seam and defined at the termination of the projection (i.e., the free end of the seam). Unless otherwise described herein, it should be understood that a specified seam width is the width of the seam at least at some point (i.e., a reference point) along an edge of the container. In various embodiments, the flexible materials or portions of flexible material at least partially joined to form the seam may have different widths. In such embodiments, the seam width, as used herein, is made with reference to the maximum seam width at the reference point. In other embodiments, the width of each of the flexible materials or portions at least partially joined to form the seam is uniform. The reference point can be, for example, in a gripping region of the container. The reference point can also be located in other regions, for example, the top, middle, or bottom region, of the container.

In accordance with embodiments of the disclosure, the seam can have a width at a reference point of about 0.1 mm to about 10 mm, about 0.5 mm to about 8 mm, about 1 mm to about 6 mm, about 2 mm to about 4 mm, about 0.1 mm to about 1 mm, or about 1 mm to about 10 mm. Other suitable widths include, about 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, 10 mm, and any range formed by any of these values. The seam can have a uniform width along the length of the seam region or can have a width that varies along the length of the seam region. For example, a seam can have a uniform width along all or a portion of the gripping region of the container. In another embodiment, the seam can have a uniform width along an entire perimeter of the container. In accordance with embodiments of the disclosure a ratio of a width of a structural support member (in an unexpanded state) at a reference point along a length of the container to the width of the seam at the reference point can be about 1 to about 1000, about 2 to about 800, about 5 to about 600 about 10 to about 400, about 15 to about 300, about 20 to about 200, about 30 to about 100, about 40 to about 90, about 50 to about 80, about 60 to about 70, about 2 to about 200, about 5 to about 150, about 4 to about 50, about 1 to about 10, or about 5 to about 9. Other suitable values include about 1, 2, 3, 4, 5, 6, 7, 8, 9, 10, 15, 20, 25, 30, 35, 40, 45, 50, 55, 60, 65, 70, 75, 80, 85, 90, 95, 100, 110, 120, 130, 140, 150, 160, 170, 180, 190, 200, 225, 250, 275, 300, 325, 350, 375, 400, 425, 450, 475, 500, 525, 550, 575, 600, 625, 650, 675, 700, 725, 750, 775, 800, 825, 850, 875, 900, 925, 950, 975, 1000 mm, and any range formed by any of these values.

The seam can have any suitable orientation relative to the side of the container from which it projects and/or one or more the structural support members adjacent to the seam. The seam orientation can be uniform or can vary along the length of the seam. Suitable orientations can include, for example, straight extensions from the intersection of the first and second film walls, curved portions or curved extensions, angled extensions towards or away from a structural support member, undulations along the width of the seam (i.e., between first and second lateral sides), and any other suitable orientations. For example, in one embodiment, the seam can be oriented so as to curl towards or along a structural support member.

Any suitable type of joining can be used to form the seam. For example, the seam can be a French seam, a scalloped seam, or a fin seal. The seam is defined by joining two or more flexible materials or portions of a flexible material at an intersection of the first and second film walls of the container in the seam region. The seam can include a first seam portion in which the flexible material(s) are joined and optionally a second seam portion where the flexible materials remain unjoined. In an embodiment, the seam can include only a first seam portion such that the flexible material(s) are joined along the entire width of the seam. In another embodiment, the seam can include a first seam portion adjacent the intersection of the first and second film walls of the container in the seam region, with the flexible material(s) of the first and second film walls being joined in the first seam portion. The seam can further include a second seam portion outboard of the first seam portion, with all or a subset of the flexible material(s) or portions of a flexible material of the first and second film walls remaining unjoined. The seam can include any suitable number of joined and unjoined portions. For example, the seam can include a joined portion along an entire length of the seam, the joined portion extending only across only a part of the width, and the remaining width can include both joined and unjoined portions. The unjoined portions of the seam can have the same or different orientations. For example, the unjoined portions of a seam can each be co-facial with one another. Alternatively one or more unjoined portions can have a non-co-facial relationship with one or more other portions of the seam. For example, in an embodiment, one of the flexible materials or portions can have a curvilinear shape such that it is not co-facial with another one of the flexible materials or portions and optionally can have a different length than the other flexible materials or portions. The seam can be trimmed or untrimmed. For example, the seam can be trimmed to have a seam profile having any suitable shape. Seams can include other patterns or shapes not defined as a profile of the seam. For example, the seam can include a straight-line profile and have circular cut outs along the seam inboard of the straight-line profile. The seam can include raised bumps, lines, or other shapes, along a portion of the seam. Such features, including the seam profile, decorative embellishments disposed on at least a portion of the seam, patterns and/or shapes cut into the seam inboard of the seam profile, and/or raised patterns disposed on the seam can function to convey to a user some information about the product contained in the container. Examples of patterns and/or shapes cut into the seam inboard of the seam profile can include, but is not limited, to through holes (or other shapes) cut into the seam inboard of the outer perimeter of the seam. For example, in an embodiment, a shelf set of container is provided with compatible products, for example, shampoo and conditioner. A pattern on or a profile of the seam can be used as a visual or tactile signal to the consumer which product is shampoo and which product is conditioner. It should be understood that shampoo and conditioner are only described herein as one exemplary shelf set and other such compatible products can be similarly included with suitable profiling and or indicia on the seam to signal to the user the type of product included in the container. It should also be understood that such profiling, patterns and/or shapes cut, and/or decorative embellishments on the seam is not limited to use in shelf sets and can be used on individual containers to signal information to the users. For example, such seam profiles, patterns and/or shapes cut into the seam, and/or decorative embellishments can be used to designate where a preferred gripping region is located on the container.

As used herein "seam profile" refers to the shape or pattern of an outer perimeter of a seam. For example, a seam can have a straight line profile, a wavy line profile, a saw-tooth profile, or any other suitable profile shape.

As used herein, the term "seam region" refers to a region of the container wherein at least a portion of a first structural support member is adjacent to at least a portion of a second structural support member. A side of the seam region defines an edge of the non-durable flexible container. The seam projects at least from the seam region. The seam region can extend along the entire length of the container or along only a portion of the length of the container. For example, the seam region can be disposed within a top, middle, or bottom region of the container, or any combination of such regions.

As used herein, when referring to a flexible container, the term "self-supporting" refers to a container that includes a product volume and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product volume is unfilled. Any of the embodiments of flexible containers, disclosed herein, can be configured to be self-supporting.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product volume, the term "single dose" refers to a product volume that is sized to contain a particular amount of product that is about equal to one unit of typical consumption, application, or use by an end user. Any of the embodiments of flexible containers, disclosed herein, can be configured to have one or more single dose product volumes. A container with only one product volume, which is a single dose product volume, is referred to herein as a "single dose container."

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, any orientation used in the fourth determining test can be considered to be a standing upright orientation.

As used herein, when referring to a flexible container, the term "stand up container" refers to a self-supporting container, wherein, when the container (with all of its product volume(s) filled 100% with water) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "structural support frame" refers to a rigid structure formed of one or more structural support members, joined together, around one or more sizable empty spaces and/or one or more nonstructural panels, and generally used as a major support in making the container self-supporting and/or standing upright.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein. The width of a structural support member can vary along the length of the structural support member or can be constant along the length of the structural support member. Unless otherwise specified, as used herein, the width of a structural support member refers to the width at a given reference point.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or all of a structural support member can be straight, curved, angled, segmented, or other shapes, or combinations of any of these shapes. Part, parts, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or all of a length. A structural support member can have any suitable cross-sectional area, any suitable overall width, and any suitable overall length. A structural support member can be substantially uniform along part, parts, or all of its length, or can vary, in any way described herein, along part, parts, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright on a horizontal support surface, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a flexible container, the term "unexpanded" refers to the state of one or more materials that are configured to be formed into a structural support volume, before the structural support volume is made rigid by an expansion material. Unless otherwise specified herein, a width of a structural support volume is measured in an unexpanded state of the structural support volume.

As used herein, when referring to a product volume of a flexible container, the term "unfilled" refers to the state of the product volume when it does not contain a fluent product.

As used herein, when referring to a flexible container, the term "unformed" refers to the state of one or more materials that are configured to be formed into a product volume, before the product volume is provided with its defined three-dimensional space. For example, an article of manufacture could be a container blank with an unformed product volume, wherein sheets of flexible material, with portions joined together, are laying flat against each other.

Flexible containers, as described herein, may be used across a variety of industries for a variety of products. For example, flexible containers, as described herein, may be used across the consumer products industry, including the following products: soft surface cleaners, hard surface cleaners, glass cleaners, ceramic tile cleaners, toilet bowl cleaners, wood cleaners, multi-surface cleaners, surface disinfectants, dishwashing compositions, laundry detergents, fabric conditioners, fabric dyes, surface protectants, surface disinfectants, cosmetics, facial powders, body powders, hair treatment products (e.g. mousse, hair spray, styling gels), shampoo, hair conditioner (leave-in or rinse-out), cream rinse, hair dye, hair coloring product, hair shine product, hair serum, hair anti-frizz product, hair split-end repair products, permanent waving solution, antidandruff formulation, bath gels, shower gels, body washes, facial cleaners, skin care products (e.g. sunscreen, sun block lotions, lip balm, skin conditioner, cold creams, moisturizers), body sprays, soaps, body scrubs, exfoliants, astringent, scrubbing lotions, depilatories, antiperspirant compositions, deodorants, shaving products, pre-shaving products, after shaving products, toothpaste, mouthwash, etc. As further examples, flexible containers, as described herein, may be used across other industries, including foods, beverages, pharmaceuticals, commercial products, industrial products, medical, etc.

FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 100.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

These terms for direction, orientation, measurement, and disposition, as described above, are used for all of the embodiments of the present disclosure, whether or not a support surface, reference line, or coordinate system is shown in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product volume 150, a dispenser 160, panels 180-1 and 180-2, and a base structure 190. A portion of panel 180-1 is illustrated as broken away, in order to show the product volume 150. The product volume 150 is configured to contain one or more fluent products. The dispenser 160 allows the container 100 to dispense these fluent product(s) from the product volume 150 through a flow channel 159 then through the dispenser 160, to the environment outside of the container 100. The structural support frame 140 supports the mass of fluent product(s) in the product volume 150, and makes the container 100 stand upright. The panels 180-1 and 180-2 are relatively flat surfaces, overlaying the product volume 150, and are suitable for displaying any kind of indicia. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members 144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all of their overall lengths, so long as there is a flow channel 159 between the top structural support members 144-1 and 144-2, which allows the container 100 to dispense fluent product(s) from the product volume 150 through the flow channel 159 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product volume 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product volume 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product volume 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
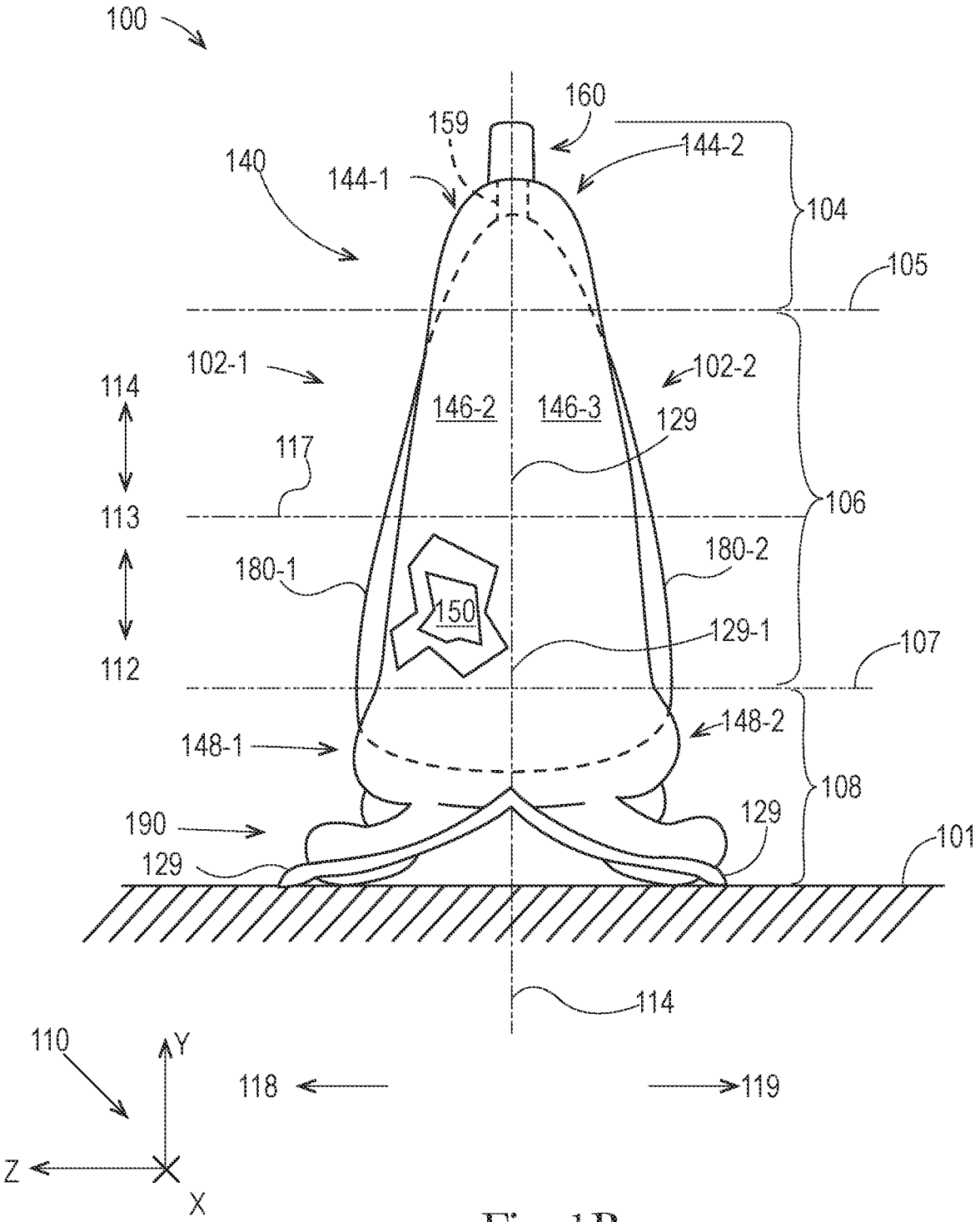
FIG. 1B illustrates a side view of the stand up flexible container of FIG. 1A.

FIG. 1B illustrates a side view of the stand up flexible container 100 of FIG. 1A.

Figure 1C:
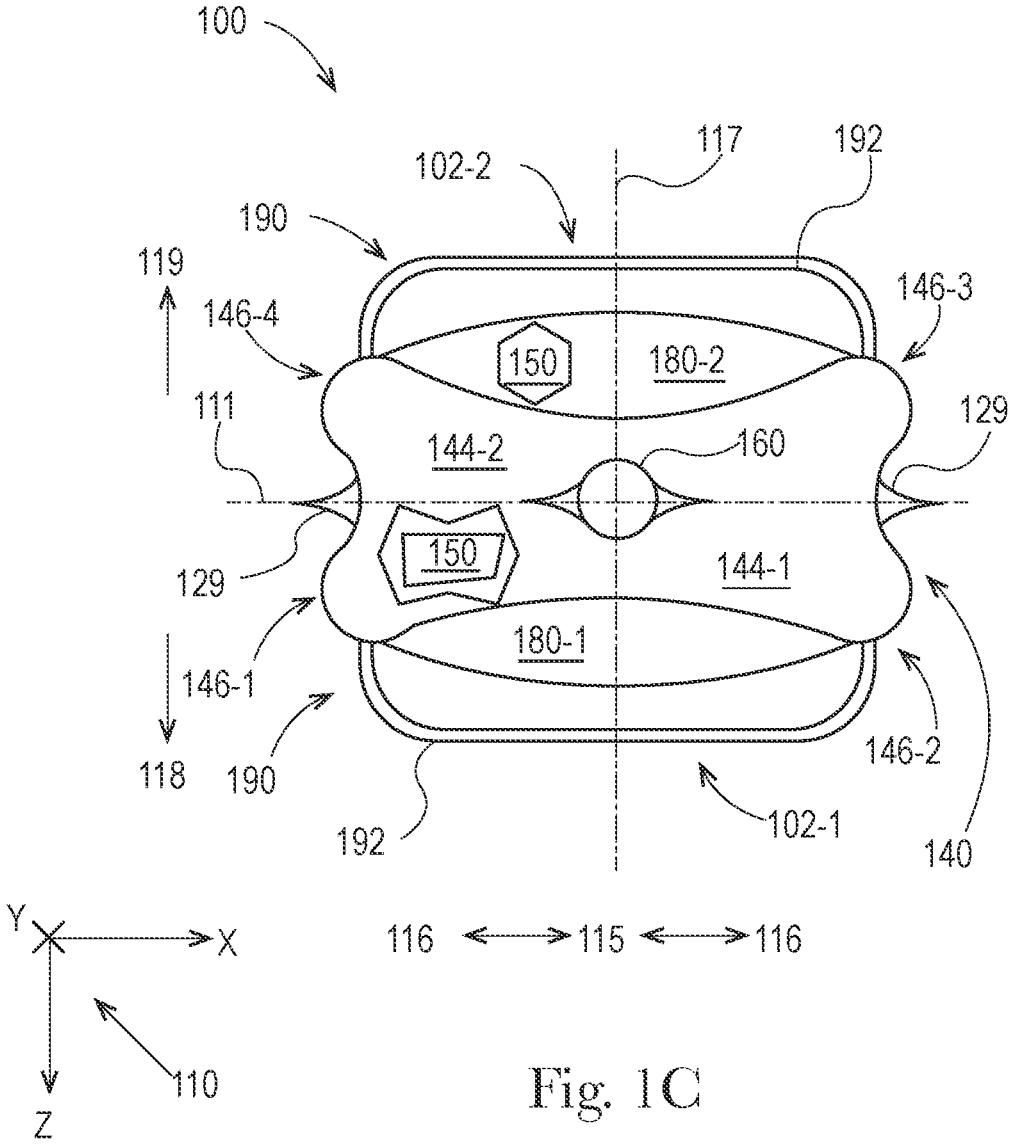
FIG. 1C illustrates a top view of the stand up flexible container of FIG. 1A.

FIG. 1C illustrates a top view of the stand up flexible container 100 of FIG. 1A.

Figure 1D:
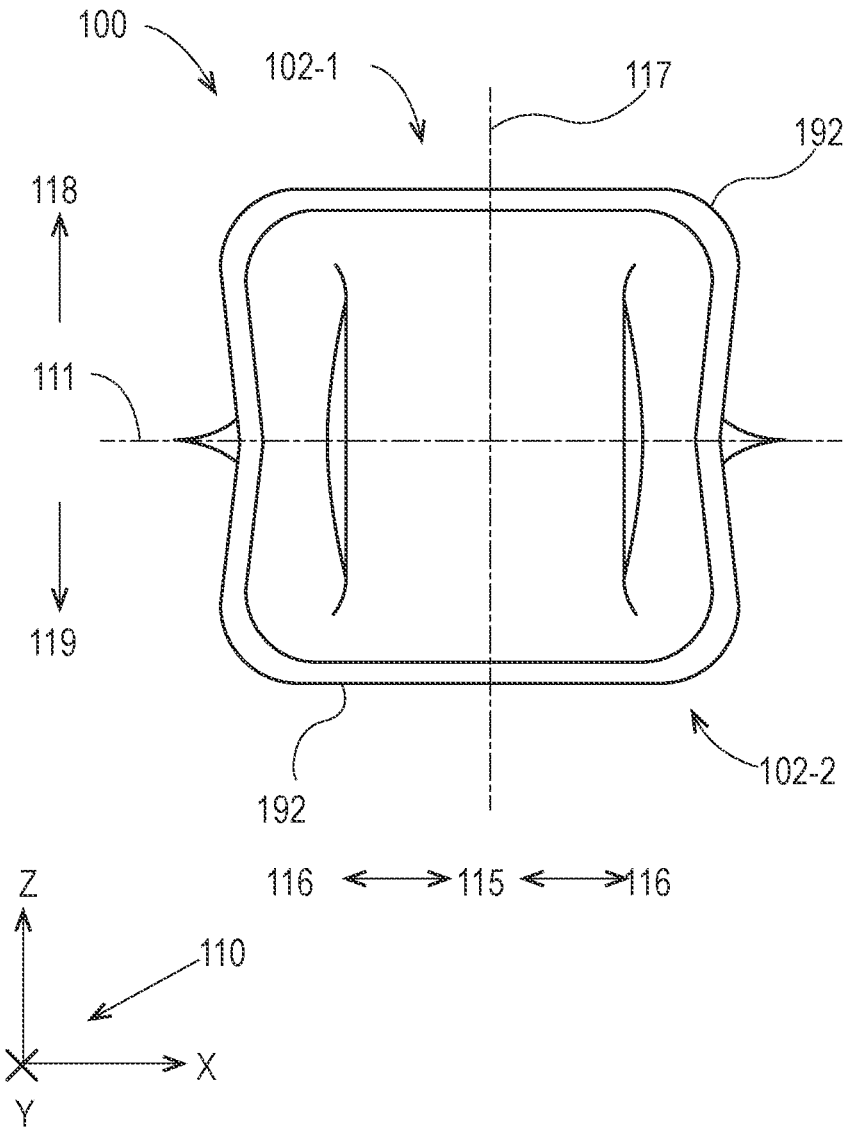
FIG. 1D illustrates a bottom view of the stand up flexible container of FIG. 1A.

FIG. 1D illustrates a bottom view of the stand up flexible container 100 of FIG. 1A.

FIGS. 2A-8D illustrate embodiments of stand-up flexible containers having various overall shapes. Any of the embodiments of FIGS. 2A-8D can be configured according to any of the embodiments disclosed herein, including the embodiments of FIGS. 1A-1D. Any of the elements (e.g. structural support frames, structural support members, panels, dispensers, etc.) of the embodiments of FIGS. 2A-8D, can be configured according to any of the embodiments disclosed herein. While each of the embodiments of FIGS. 2A-8D illustrates a container with one dispenser, in various embodiments, each container can include multiple dispensers, according to any embodiment described herein. Part, parts, or all of each of the panels in the embodiments of FIGS. 2A-8D is suitable to display any kind of indicia. Each of the side panels in the embodiments of FIGS. 2A-8D is configured to be a nonstructural panel, overlaying product volume(s) disposed within the flexible container, however, in various embodiments, one or more of any kind of decorative or structural element (such as a rib, protruding from an outer surface) can be joined to part, parts, or all of any of these side panels. For clarity, not all structural details of these flexible containers are shown in FIGS. 2A-8D, however any of the embodiments of FIGS. 2A-8D can be configured to include any structure or feature for flexible containers, disclosed herein. For example, any of the embodiments of FIGS. 2A-8D can be configured to include any kind of base structure disclosed herein.

Figure 2B:
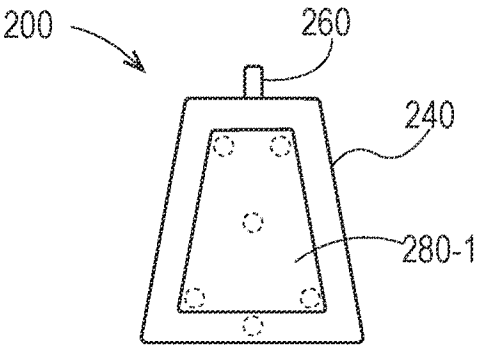
FIG. 2B illustrates a front view of the container of FIG. 2A.
Figure 2D:
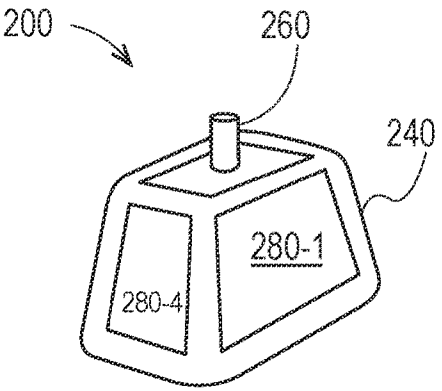
FIG. 2D illustrates an isometric view of the container of FIG. 2A.
Figure 2A:
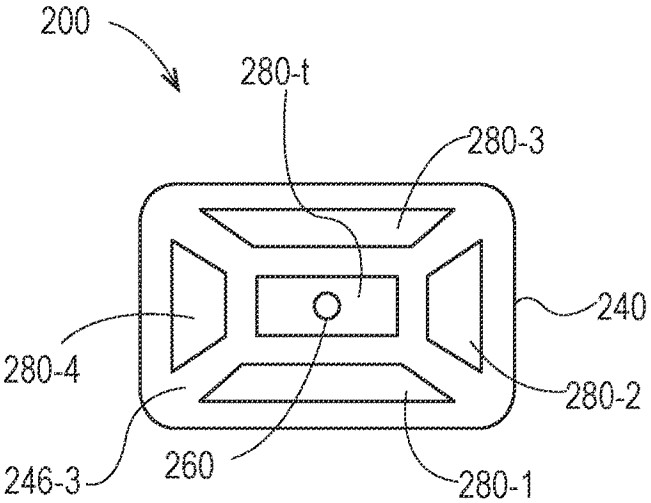
FIG. 2A illustrates a top view of a stand up flexible container having a structural support frame that has an overall shape like a frustum.
Figure 2C:
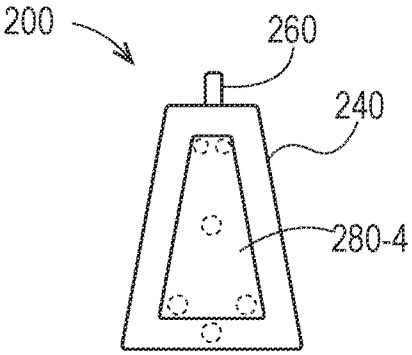
FIG. 2C illustrates a side view of the container of FIG. 2A.

FIG. 2A illustrates a front view of a stand up flexible container 200 having a structural support frame 240 that has an overall shape like a frustum. In the embodiment of FIG. 2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or all of any of the side panels can be approximately flat, substantially flat, nearly flat, or completely flat. The container 200 includes a dispenser 260, which is configured to dispense one or more fluent products from one or more product volumes disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (shown as phantom lines), any of which can apply to either side of the container. FIG. 2D illustrates an isometric view of the container 200 of FIG. 2A.

Figure 3A:
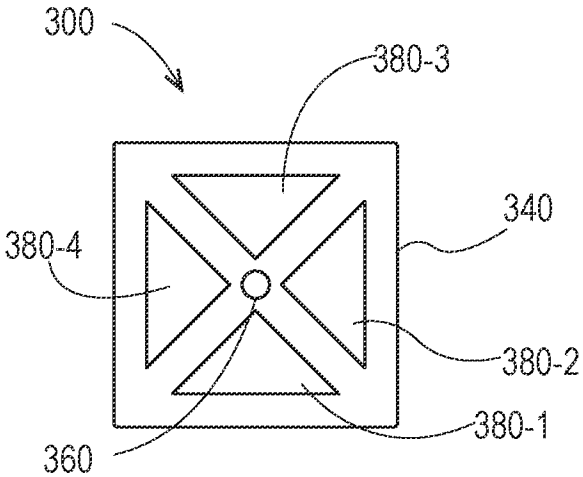
FIG. 3A illustrates a top view of a stand up flexible container having a structural support frame that has an overall shape like a pyramid.
Figure 3B:
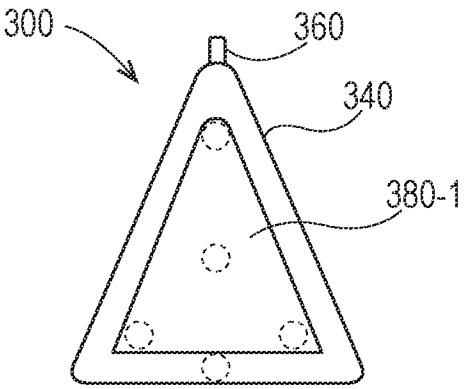
FIG. 3B illustrates a front view of the container of FIG. 3A.
Figure 3C:
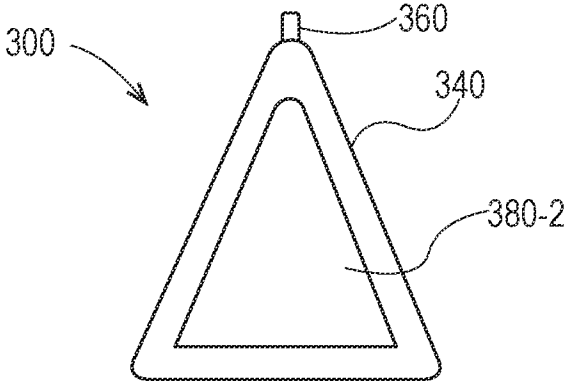
FIG. 3C illustrates a side view of the container of FIG. 3A.
Figure 3D:
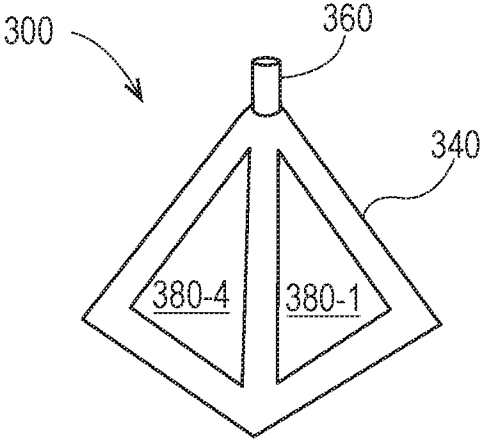
FIG. 3D illustrates an isometric view of the container of FIG. 3A.

FIG. 3A illustrates a front view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or all of any of the side panels can be approximately flat, substantially flat, nearly flat, or completely flat. The container 300 includes a dispenser 360, which is configured to dispense one or more fluent products from one or more product volumes disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (shown as phantom lines), any of which can also apply to any side of the container. FIG. 3C illustrates a side view of the container 300 of FIG. 3A. FIG. 3D illustrates an isometric view of the container 300 of FIG. 3A.

Figure 4B:
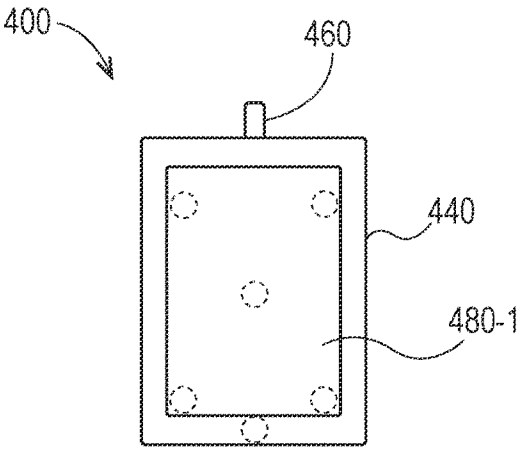
FIG. 4B illustrates a front view of the container of FIG. 4A.
Figure 4A:
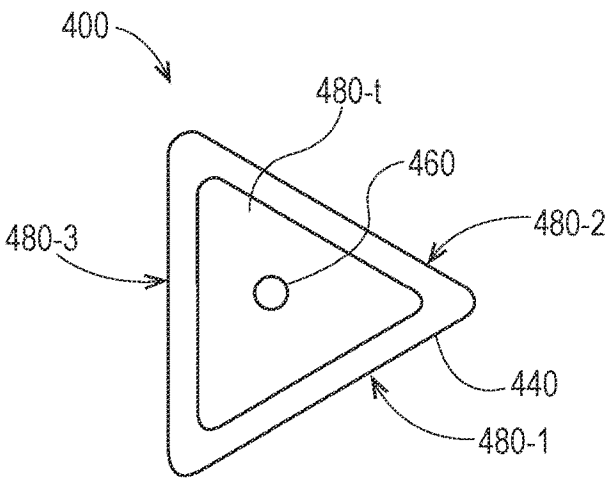
FIG. 4A illustrates a top view of a stand up flexible container having a structural support frame that has an overall shape like a trigonal prism.

FIG. 4A illustrates a front view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or all of any of the side panels can be approximately flat, substantially flat, nearly flat, or completely flat.

Figure 4D:
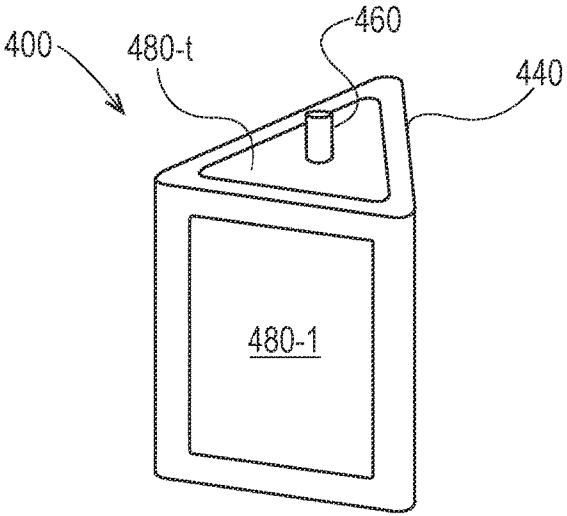
FIG. 4D illustrates an isometric view of the container of FIG. 4A.
Figure 4C:
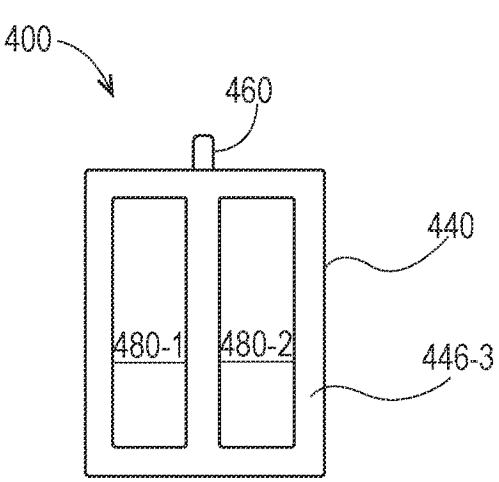
FIG. 4C illustrates a side view of the container of FIG. 4A.

The container 400 includes a dispenser 460, which is configured to dispense one or more fluent products from one or more product volumes disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (shown as phantom lines), any of which can also apply to any side of the container 400. FIG. 4C illustrates a side view of the container 400 of FIG. 4A. FIG. 4D illustrates an isometric view of the container 400 of FIG. 4A.

Figure 5B:
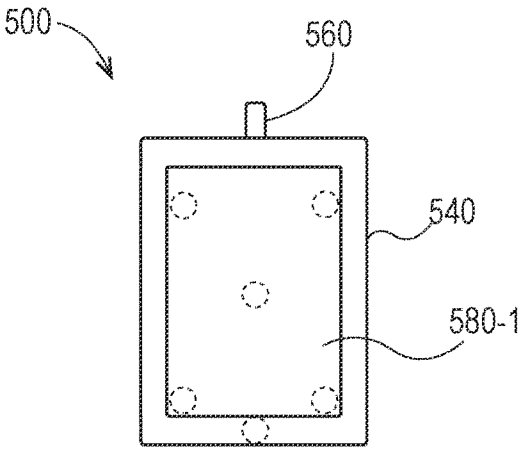
FIG. 5B illustrates a front view of the container of FIG. 5A.
Figure 5D:
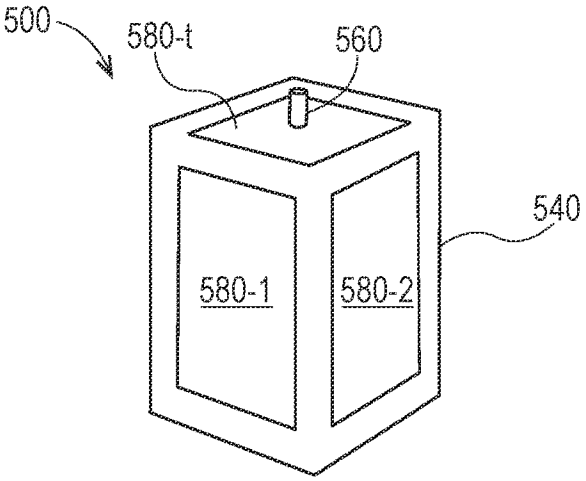
FIG. 5D illustrates an isometric view of the container of FIG. 5A.
Figure 5A:
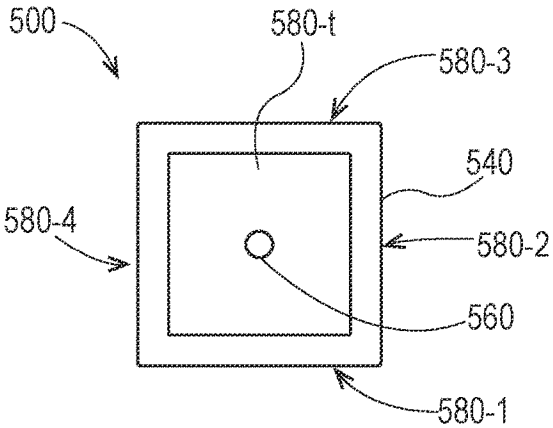
FIG. 5A illustrates a top view of a stand up flexible container having a structural support frame that has an overall shape like a tetragonal prism.
Figure 5C:
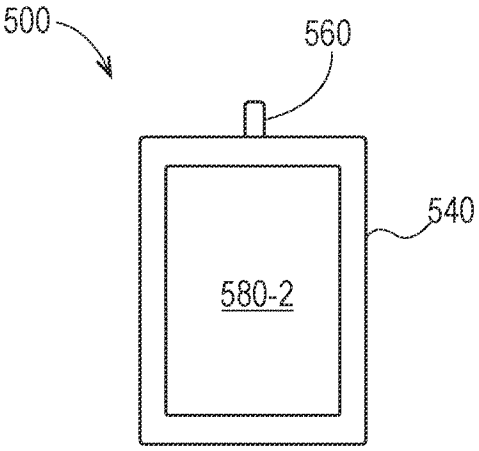
FIG. 5C illustrates a side view of the container of FIG. 5A.

FIG. 5A illustrates a front view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or all of any of the side panels can be approximately flat, substantially flat, nearly flat, or completely flat. The container 500 includes a dispenser 560, which is configured to dispense one or more fluent products from one or more product volumes disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (shown as phantom lines), any of which can also apply to any side of the container 500. FIG. 5C illustrates a side view of the container 500 of FIG. 5A. FIG. 5D illustrates an isometric view of the container 500 of FIG. 5A.

Figure 6B:
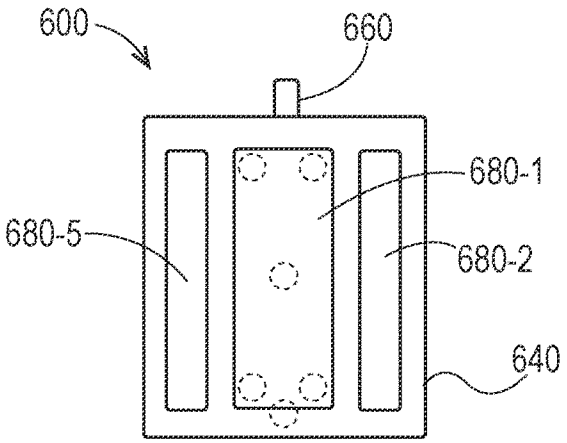
FIG. 6B illustrates a front view of the container of FIG. 6A.
Figure 6D:
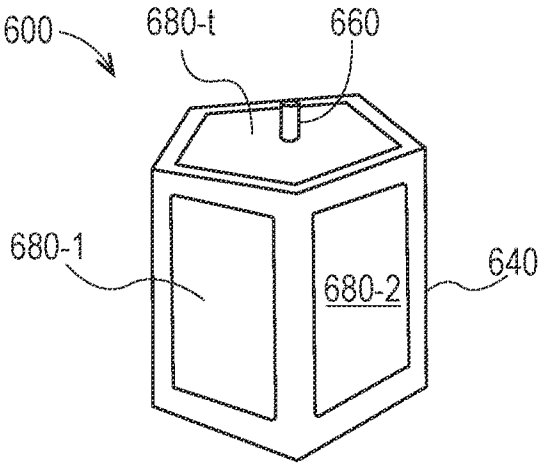
FIG. 6D illustrates an isometric view of the container of FIG. 6A.
Figure 6A:
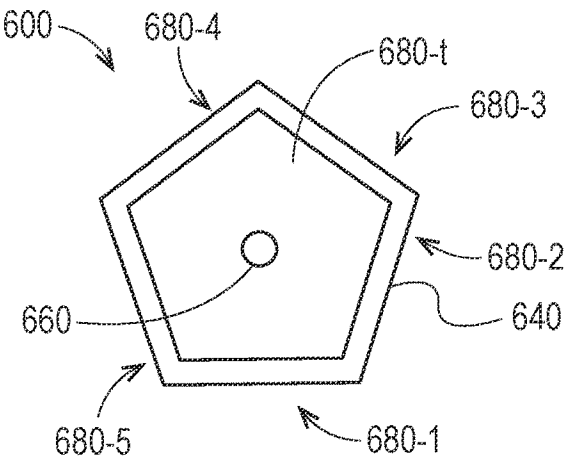
FIG. 6A illustrates a top view of a stand up flexible container having a structural support frame that has an overall shape like a pentagonal prism.
Figure 6C:
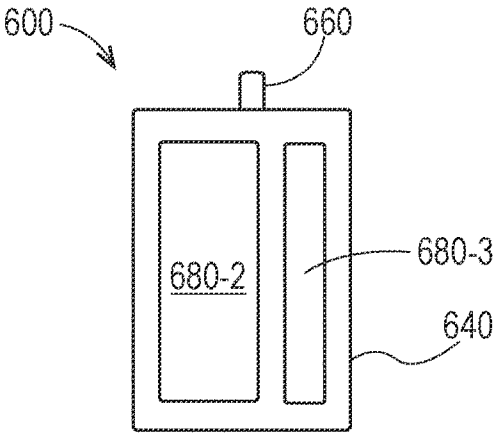
FIG. 6C illustrates a side view of the container of FIG. 6A.

FIG. 6A illustrates a front view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or all of any of the side panels can be approximately flat, substantially flat, nearly flat, or completely flat. The container 600 includes a dispenser 660, which is configured to dispense one or more fluent products from one or more product volumes disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (shown as phantom lines), any of which can also apply to any side of the container 600. FIG. 6C illustrates a side view of the container 600 of FIG. 6A. FIG. 6D illustrates an isometric view of the container 600 of FIG. 6A.

Figure 7B:
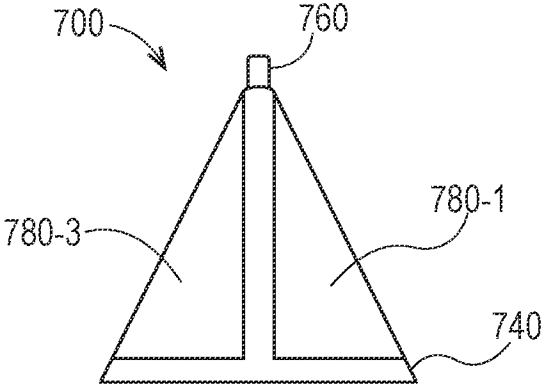
FIG. 7B illustrates a front view of the container of FIG. 7A.
Figure 7D:
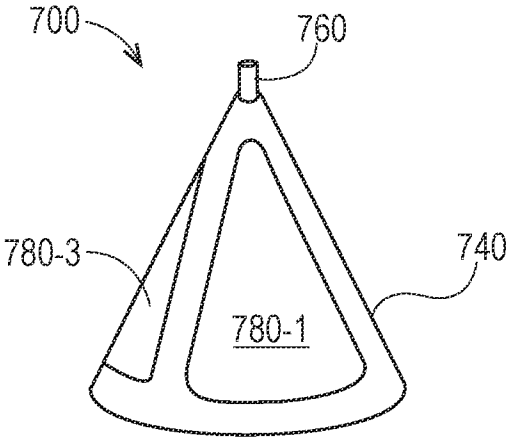
FIG. 7D illustrates an isometric view of the container of FIG. 7A.
Figure 7A:
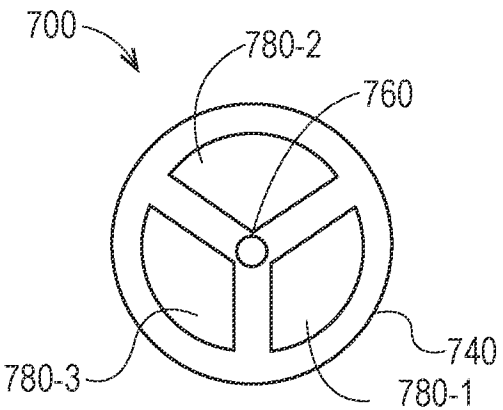
FIG. 7A illustrates a top view of a stand up flexible container having a structural support frame that has an overall shape like a cone.
Figure 7C:
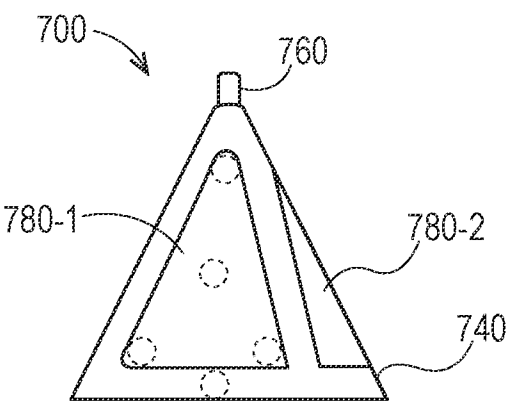
FIG. 7C illustrates a side view of the container of FIG. 7A.

FIG. 7A illustrates a front view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or all of any of the side panels can be approximately flat, substantially flat, nearly flat, or completely flat. The container 700 includes a dispenser 760, which is configured to dispense one or more fluent products from one or more product volumes disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (shown as phantom lines), any of which can also apply to any side panel of the container 700. FIG. 7D illustrates an isometric view of the container 700 of FIG. 7A.

Figure 8B:
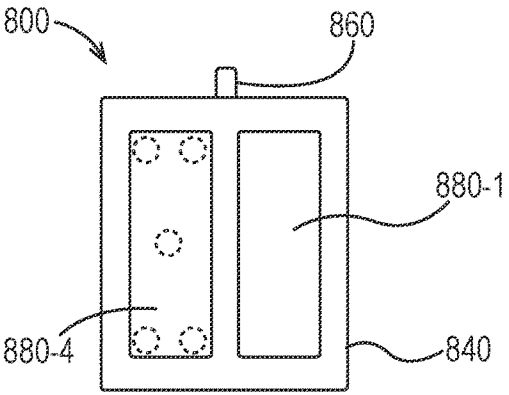
FIG. 8B illustrates a front view of the container of FIG. 8A.
Figure 8A:
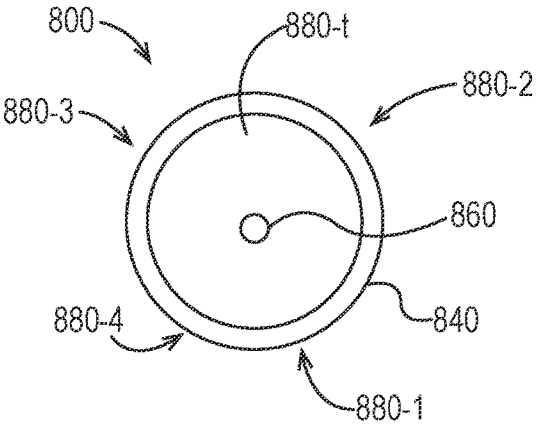
FIG. 8A illustrates a top view of a stand up flexible container having a structural support frame that has an overall shape like a cylinder.
Figure 8D:
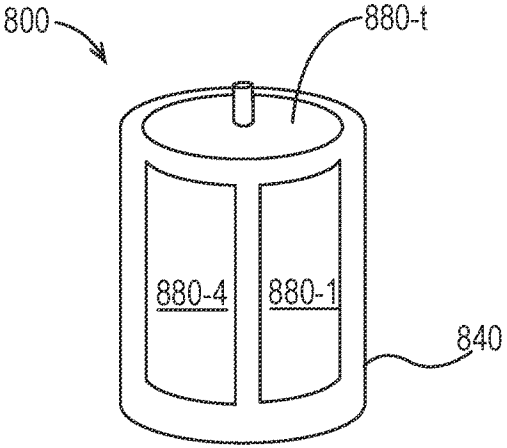
FIG. 8D illustrates an isometric view of the container of FIG. 8A.
Figure 8C:
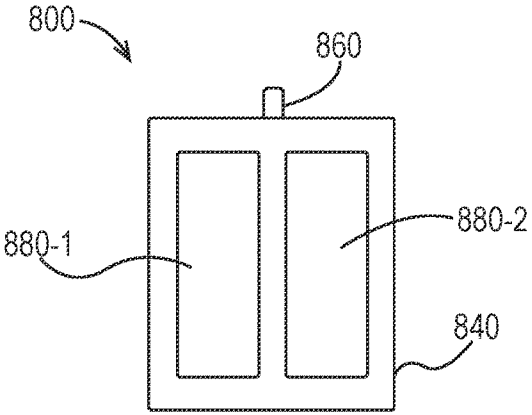
FIG. 8C illustrates a side view of the container of FIG. 8A.

FIG. 8A illustrates a front view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel 880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or all of any of the side panels can be approximately flat, substantially flat, nearly flat, or completely flat. The container 800 includes a dispenser 860, which is configured to dispense one or more fluent products from one or more product volumes disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (shown as phantom lines), any of which can also apply to any side panel of the container 800. FIG. 8C illustrates a side view of the container 800 of FIG. 8A. FIG. 8D illustrates an isometric view of the container 800 of FIG. 8A.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
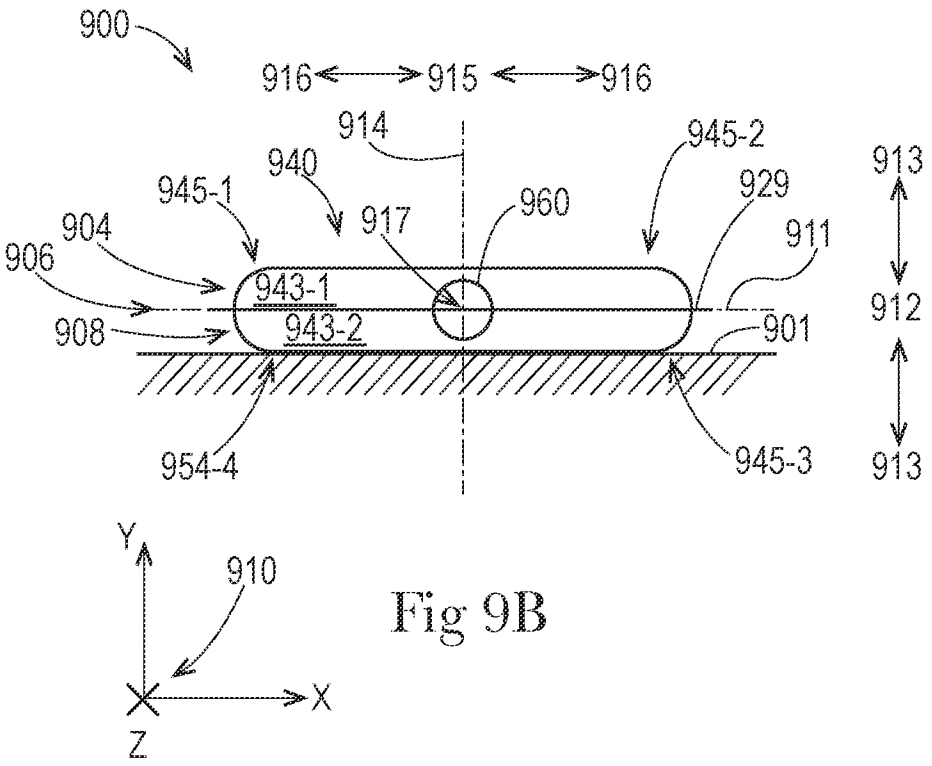
FIG. 9B illustrates an end view of the flexible container of FIG. 9A.
Figure 9A:
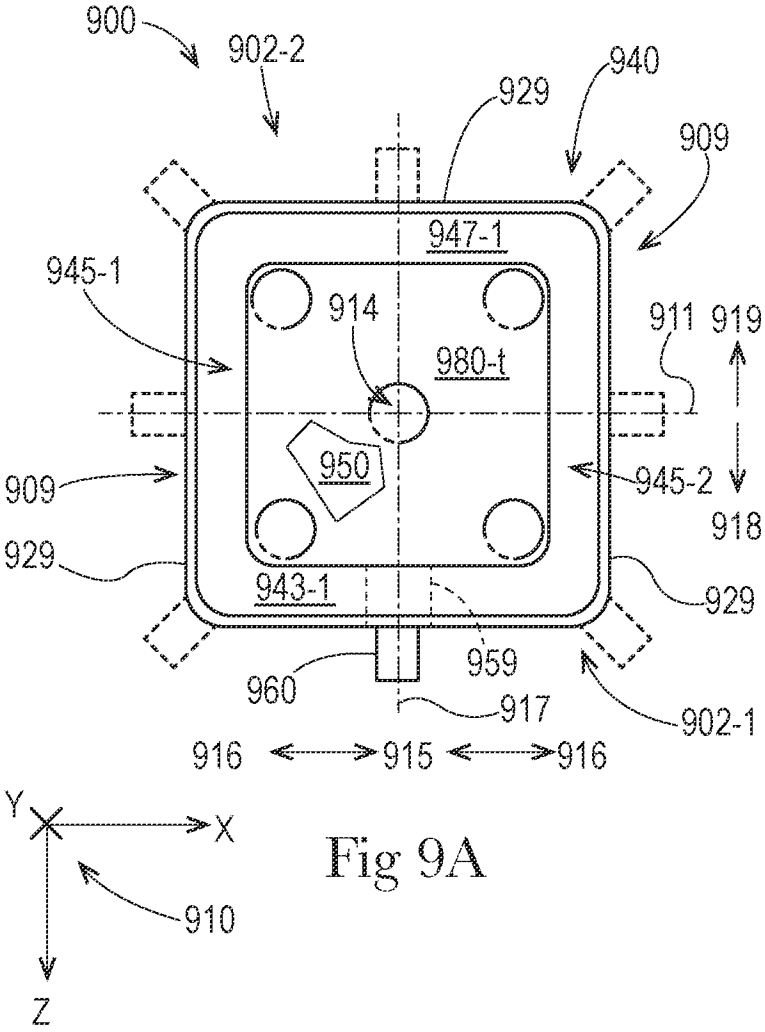
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 100. A lateral centerline 911 runs parallel to the X-axis. An XY plane at the lateral centerline 911 separates the container 100 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900.

The container 900 includes a structural support frame 940, a product volume 950, a dispenser 960, a top panel 980-*t* and a bottom panel (not shown). A portion of the top panel 980-*t* is illustrated as broken away, in order to show the product volume 950. The product volume 950 is configured to contain one or more fluent products. The dispenser 960 allows the container 900 to dispense these fluent product(s) from the product volume 950 through a flow channel 959 then through the dispenser 960, to the environment outside of the container 900. The structural support frame 940 supports the mass of fluent product(s) in the product volume 950. The top panel 980-*t* and the bottom panel are relatively flat surfaces, overlaying the product volume 950, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all of their overall lengths, so long as there is a gap in the contact for the flow channel 959, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product volume 950, and the ends of structural support members 943-2, 945-3, 947-2, and 945-4 are also joined together to form a bottom square that is outward from and surrounding the product volume 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

FIGS. 10A-11B illustrate embodiments of self-supporting flexible containers (that are not stand up containers) having various overall shapes. Any of the embodiments of FIGS. 10A-11B can be configured according to any of the embodiments disclosed herein, including the embodiments of FIGS. 9A-9B. Any of the elements (e.g. structural support frames, structural support members, panels, dispensers, etc.) of the embodiments of FIGS. 10A-11B, can be configured according to any of the embodiments disclosed herein. While each of the embodiments of FIGS. 10A-11B illustrates a container with one dispenser, in various embodiments, each container can include multiple dispensers, according to any embodiment described herein. Part, parts, or all of each of the panels in the embodiments of FIGS. 10A-11B is suitable to display any kind of indicia. Each of the top and bottom panels in the embodiments of FIGS. 10A-11B is configured to be a nonstructural panel, overlaying product volume(s) disposed within the flexible container, however, in various embodiments, one or more of any kind of decorative or structural element (such as a rib, protruding from an outer surface) can be joined to part, parts, or all of any of these panels. For clarity, not all structural details of these flexible containers are shown in FIGS. 10A-11B, however any of the embodiments of FIGS. 10A-11B can be configured to include any structure or feature for flexible containers, disclosed herein.

Figure 10B:
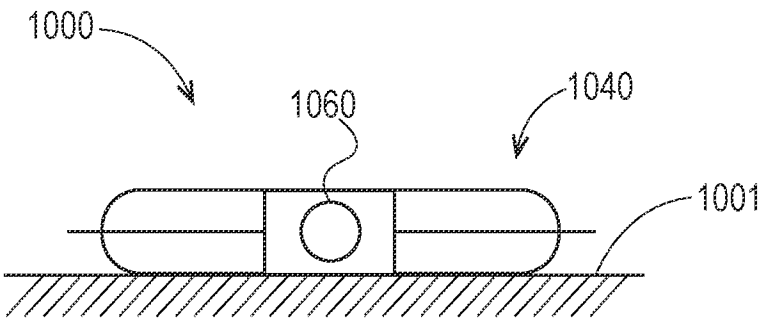
FIG. 10B illustrates an end view of the flexible container of FIG. 10A.
Figure 10A:
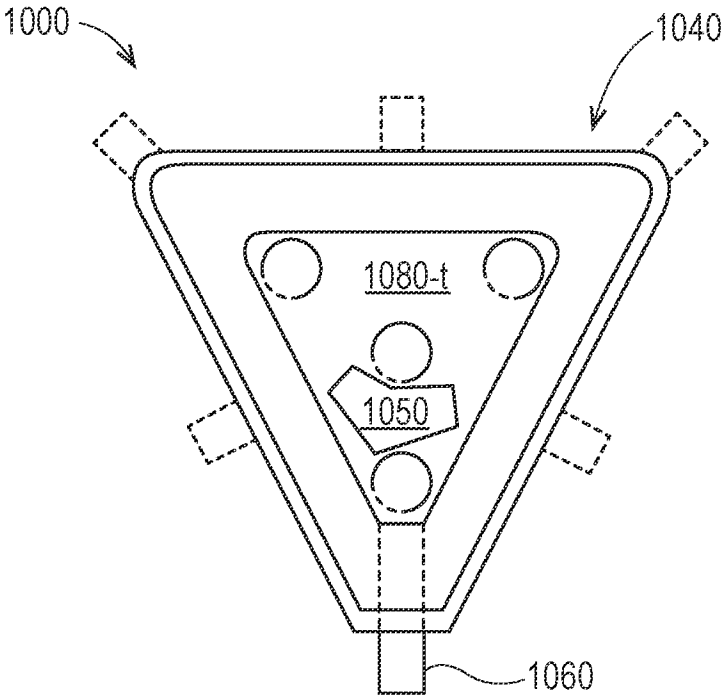
FIG. 10A illustrates a top view of an embodiment of a self-supporting flexible container, having an overall shape like a triangle.

FIG. 10A illustrates a top view of an embodiment of a self-supporting flexible container 1000 (that is not a stand-up flexible container) having an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or all of any of the side panels can be approximately flat, substantially flat, nearly flat, or completely flat. The container 1000 includes a dispenser 1060, which is configured to dispense one or more fluent products from one or more product volumes disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (shown as phantom lines). FIG. 10B illustrates an end view of the flexible container 1000 of FIG. 10B, resting on a horizontal support surface 1001.

Figure 11B:
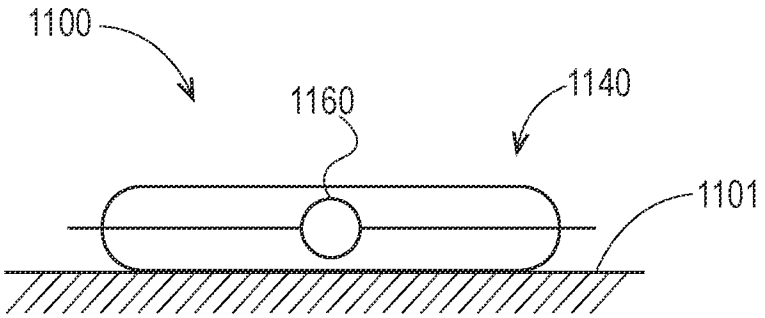
FIG. 11B illustrates an end view of the flexible container of FIG. 11A.
Figure 11A:
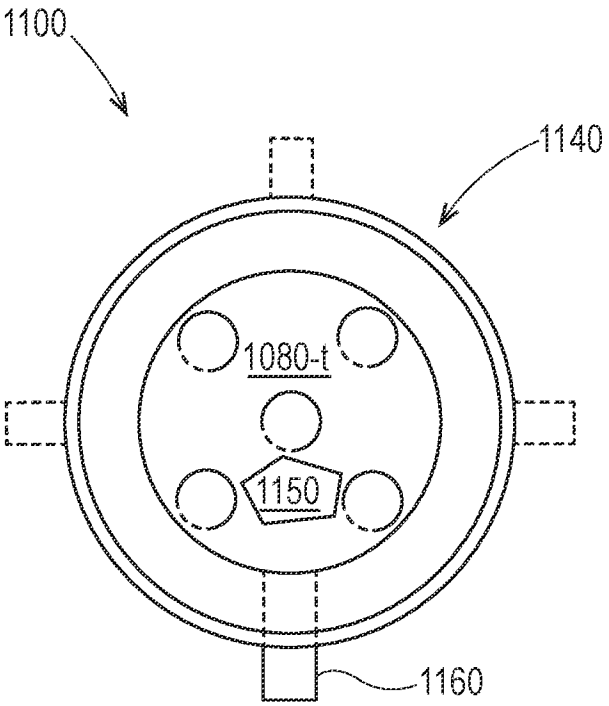
FIG. 11A illustrates a top view of an embodiment of a self-supporting flexible container, having an overall shape like a circle.

FIG. 11A illustrates a top view of an embodiment of a self-supporting flexible container 1100 (that is not a stand-up flexible container) having an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or all of any of the side panels can be approximately flat, substantially flat, nearly flat, or completely flat. The container 1100 includes a dispenser 1160, which is configured to dispense one or more fluent products from one or more product volumes disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (shown as phantom lines). FIG. 11B illustrates an end view of the flexible container 1100 of FIG. 10B, resting on a horizontal support surface 1101.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
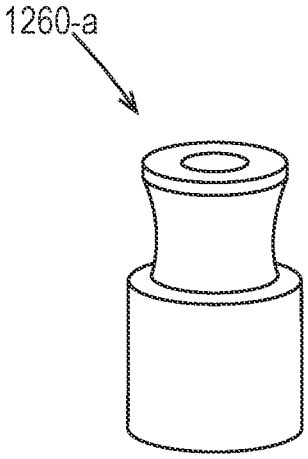
FIG. 12A illustrates an isometric view of push-pull type dispenser.
Figure 12B:
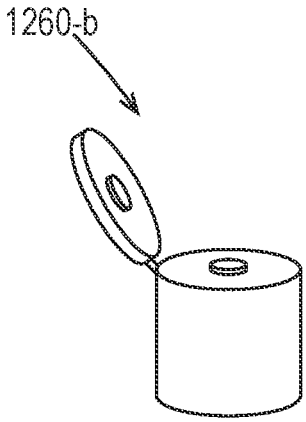
FIG. 12B illustrates an isometric view of dispenser with a flip-top cap.
Figure 12C:
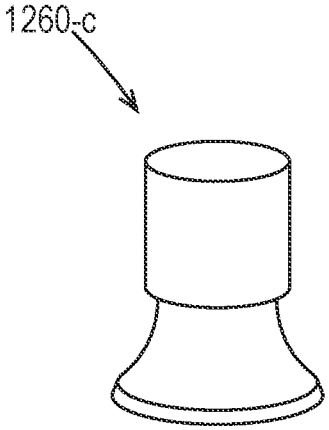
FIG. 12C illustrates an isometric view of dispenser with a screw-on cap.
Figure 12D:
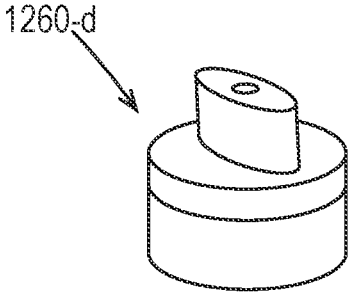
FIG. 12D illustrates an isometric view of rotatable type dispenser.
Figure 12E:
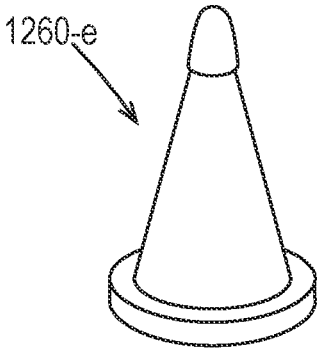
FIG. 12E illustrates an isometric view of nozzle type dispenser with a cap.
Figures 13A, 13B, 13C, 13D:
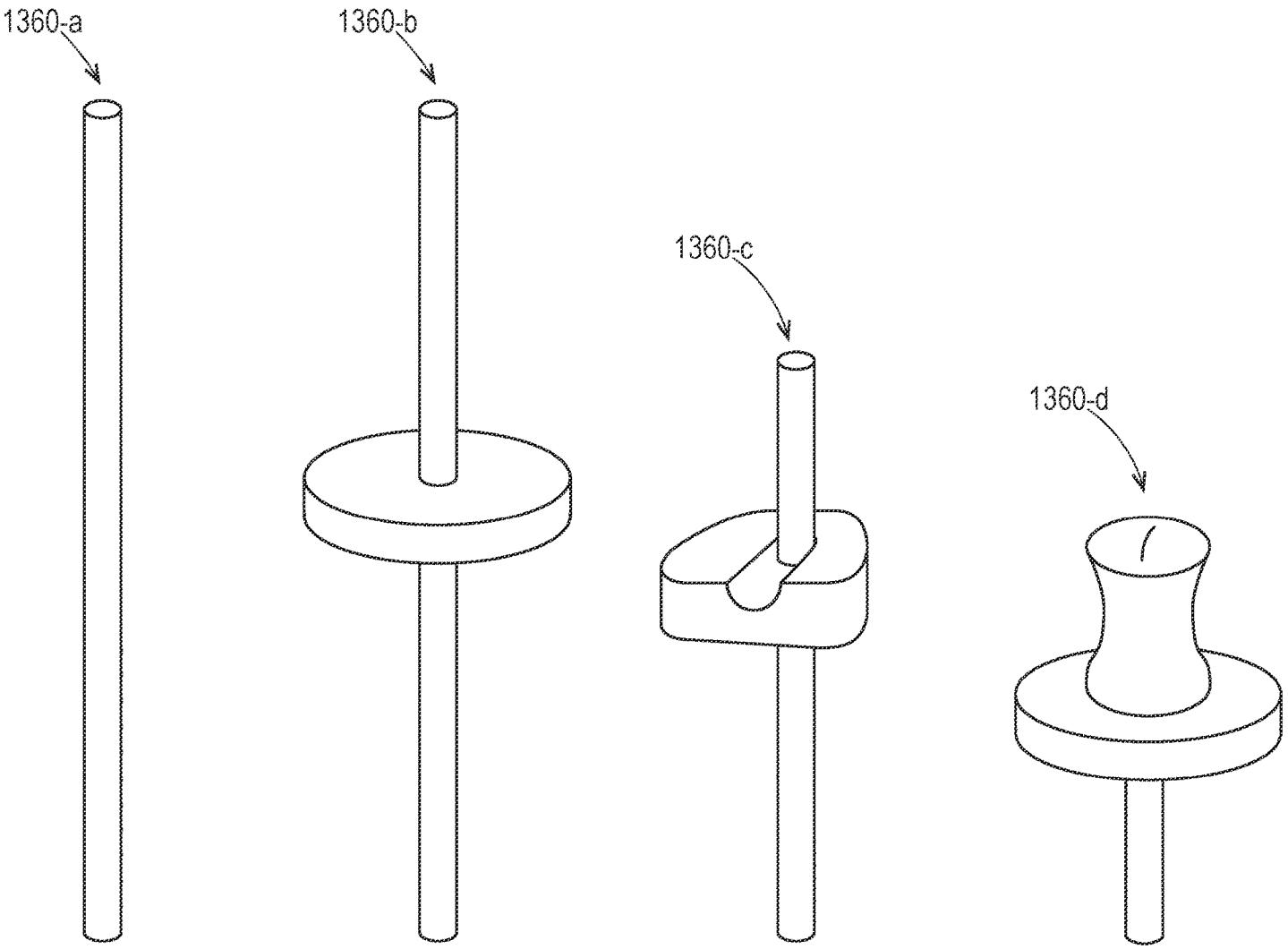
FIG. 13A illustrates an isometric view of straw dispenser.
FIG. 13B illustrates an isometric view of straw dispenser with a lid.
FIG. 13C illustrates an isometric view of flip up straw dispenser.
FIG. 13D illustrates an isometric view of straw dispenser with bite valve.
Figure 14C:
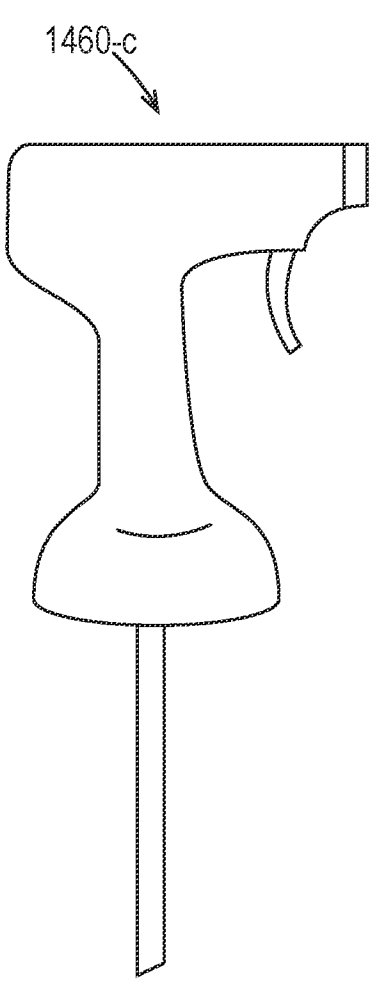
FIG. 14C illustrates an isometric view of trigger spray type dispenser.
Figure 14B:
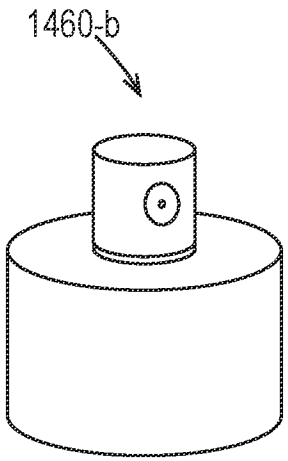
FIG. 14B illustrates an isometric view of pump spray type dispenser.
Figure 14A:
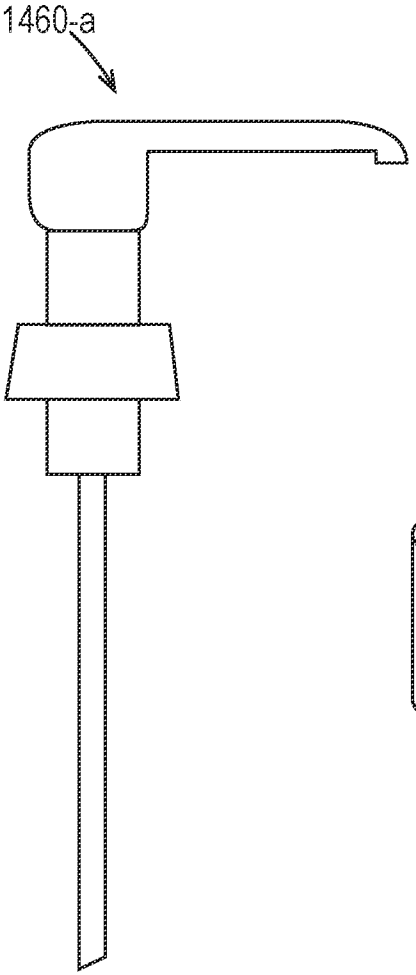
FIG. 14A illustrates an isometric view of pump type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*. FIG. 14B illustrates an isometric view of pump spray type dispenser 1460-*b*. FIG. 14C illustrates an isometric view of trigger spray type dispenser 1460-*c*.

Conventional flexible containers can include rigid seams on the edge of the container, which can make the containers difficult or unpleasant to handle and give the flexible container an unfinished look. Containers in accordance with embodiments of the disclosure can advantageously provide an improved user interaction with the containers by preventing or mitigating sharp, rigid seams from contacting the user when the user handles the container. In some embodiments, a seam extending around a perimeter of the container can be effectively reduced, which can give the container a more finished appearance as well as improve the user's interaction with the container.

Figure 15:
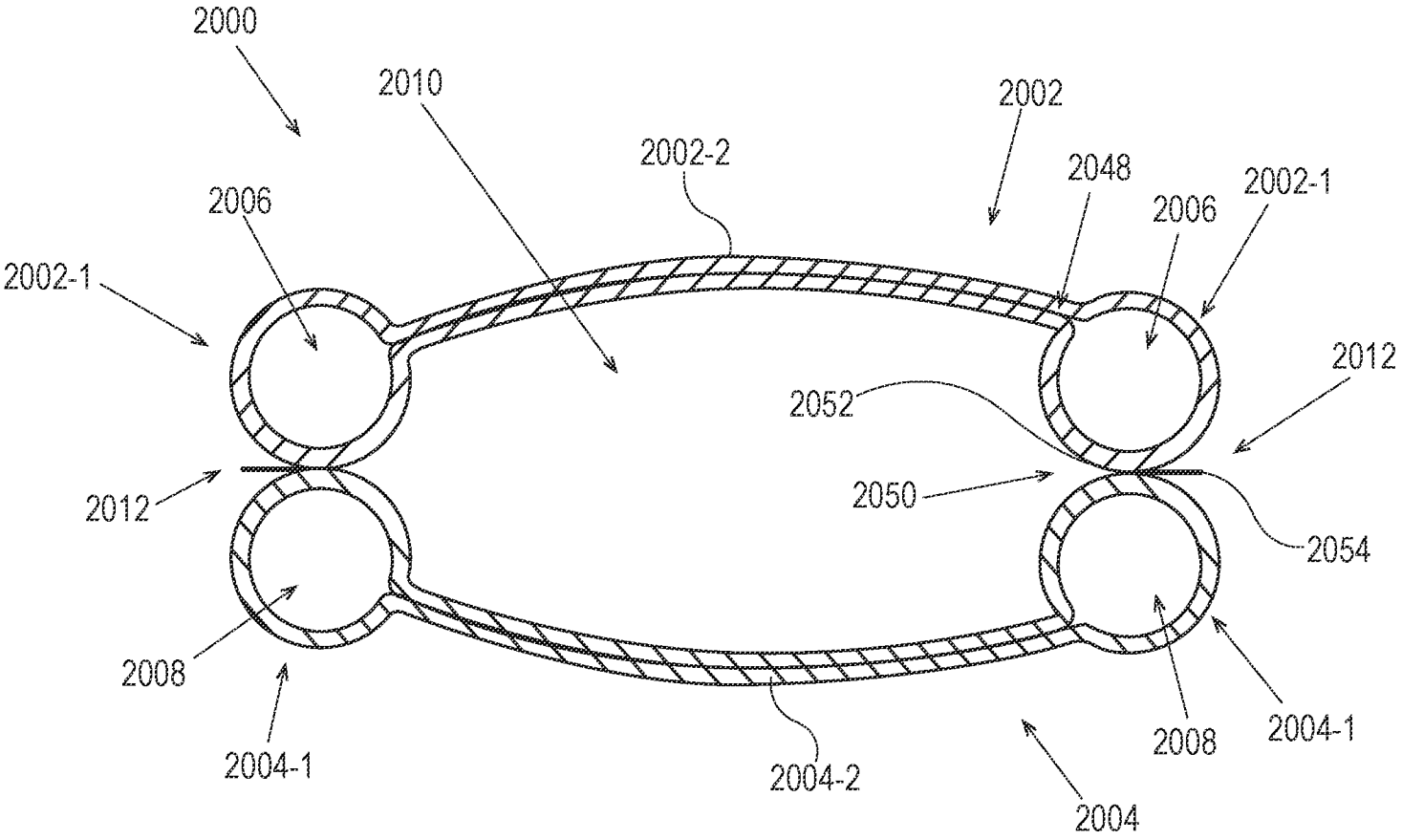
FIG. 15 illustrates a cross-sectional view of a container in accordance with an embodiment of the disclosure.
Figure 18:
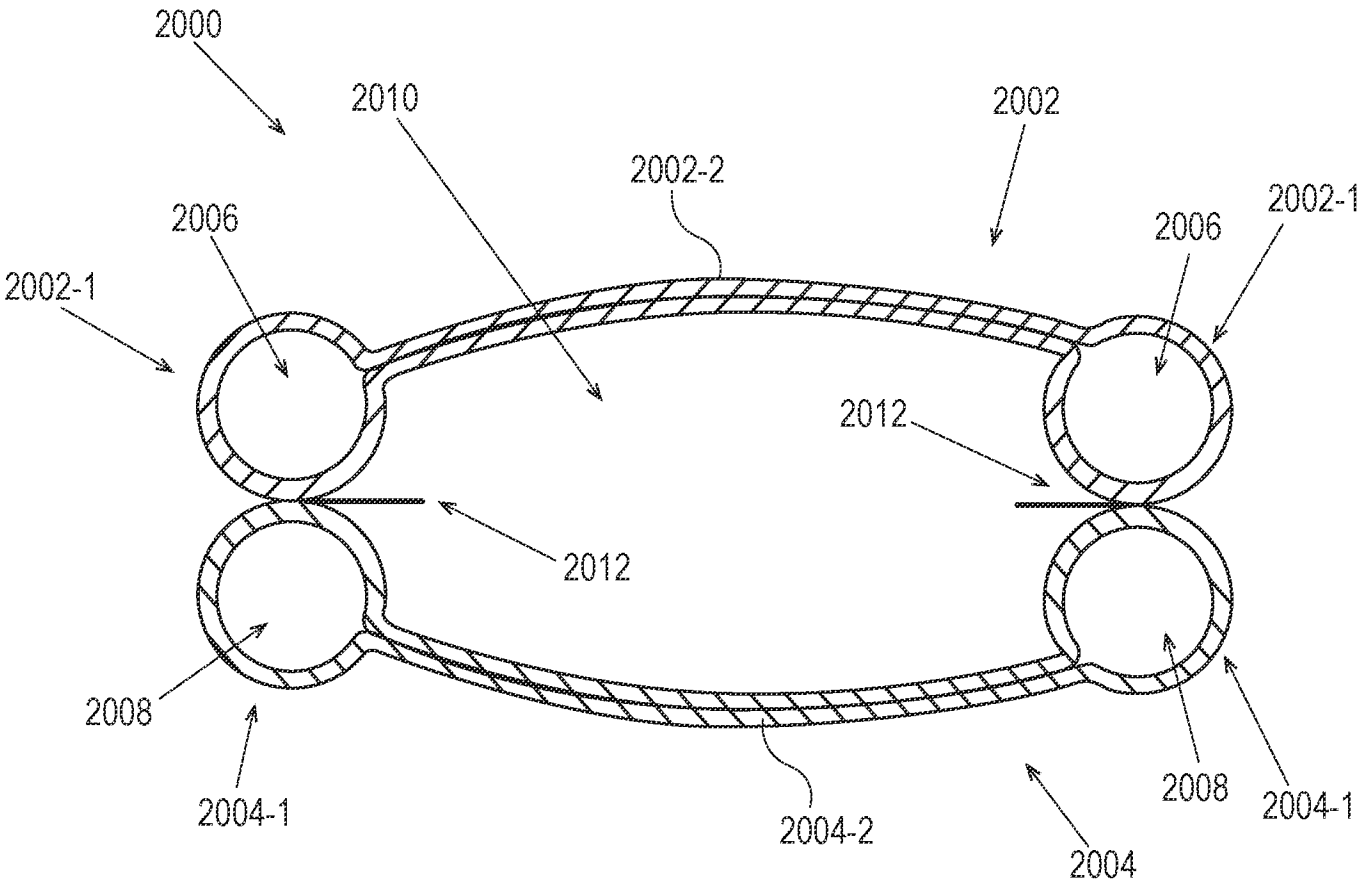
FIG. 18 illustrates a cross-sectional view of a container formed by inverting the container blank, in accordance with an embodiment of the disclosure.

Referring to FIG. 15, in accordance with an embodiment of the disclosure, a container can include first and second walls 2002, 2004. One or both of the first and second walls can include a first portion 2002-1, 2004-2 that includes a structural support member and a second portion 2002-2, 2004-2 that is free of a structural support member. FIG. 15 illustrates an embodiment in which both the first and second walls 2002, 2004 include a portion 2002-2, 2004-2 that is free of a structurally support member. At least a portion of the first structural support member 2006 is adjacent to at least a portion of the second structural support member 2008 to define a seam region. A side of the seam region defines an edge of the non-durable flexible container. The container can further include a seam 2012 projecting outwardly from the seam region at the intersection of the first and second walls. In some embodiments, for example, as illustrated in FIG. 18, the seam can project inwardly into the product volume. In such embodiments, the container blank is inverted to provide one or more seams 2012 that projects inwardly as opposed to outwardly from the seam region.

The container can further include a product volume 2010. The product volume 2010 can be a closed product volume.

Figure 16:
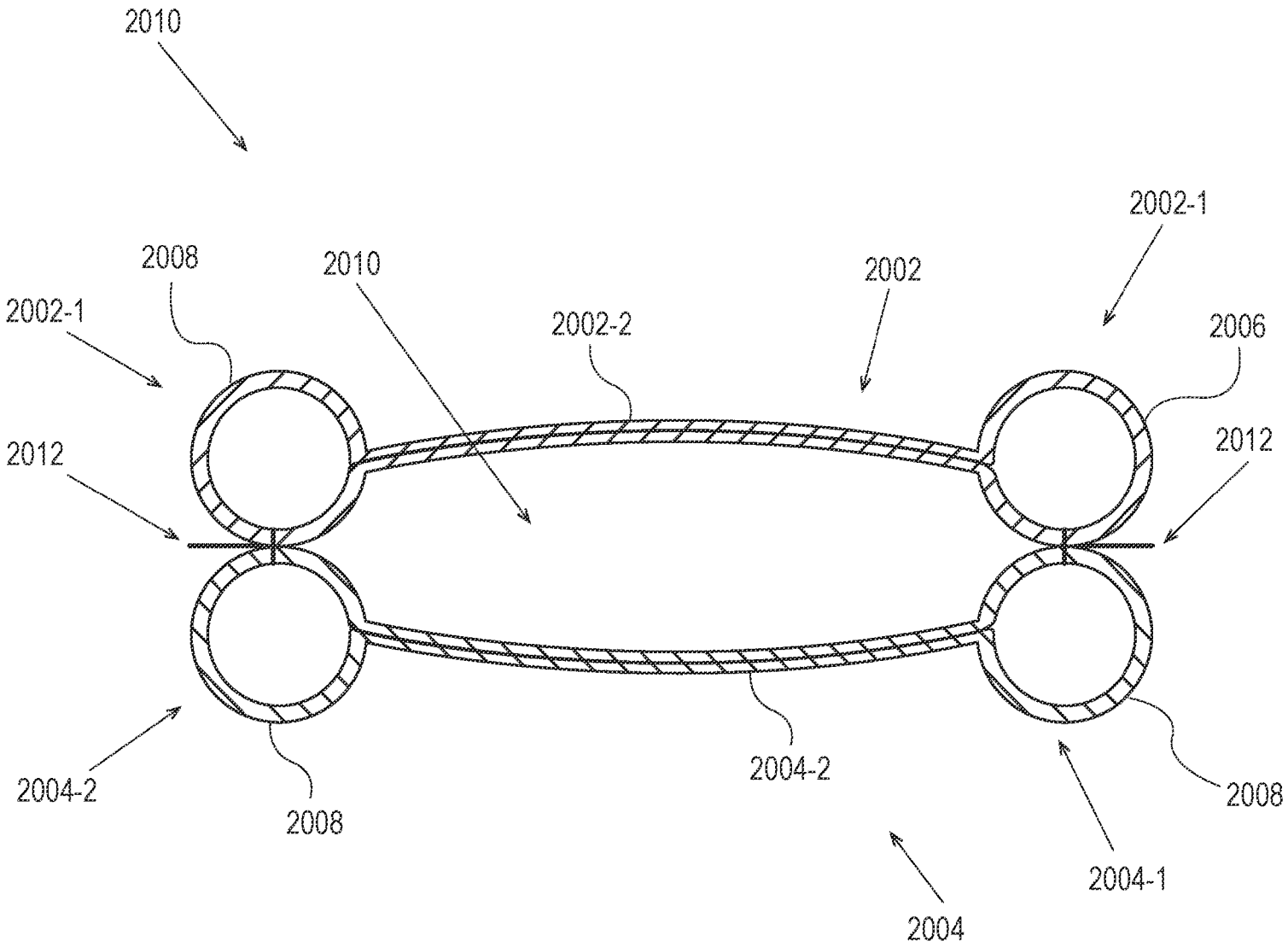
FIG. 16 illustrates a cross-sectional view of a container having increased tension in the first and second film walls in accordance with another embodiment of the disclosure.
Figure 17:
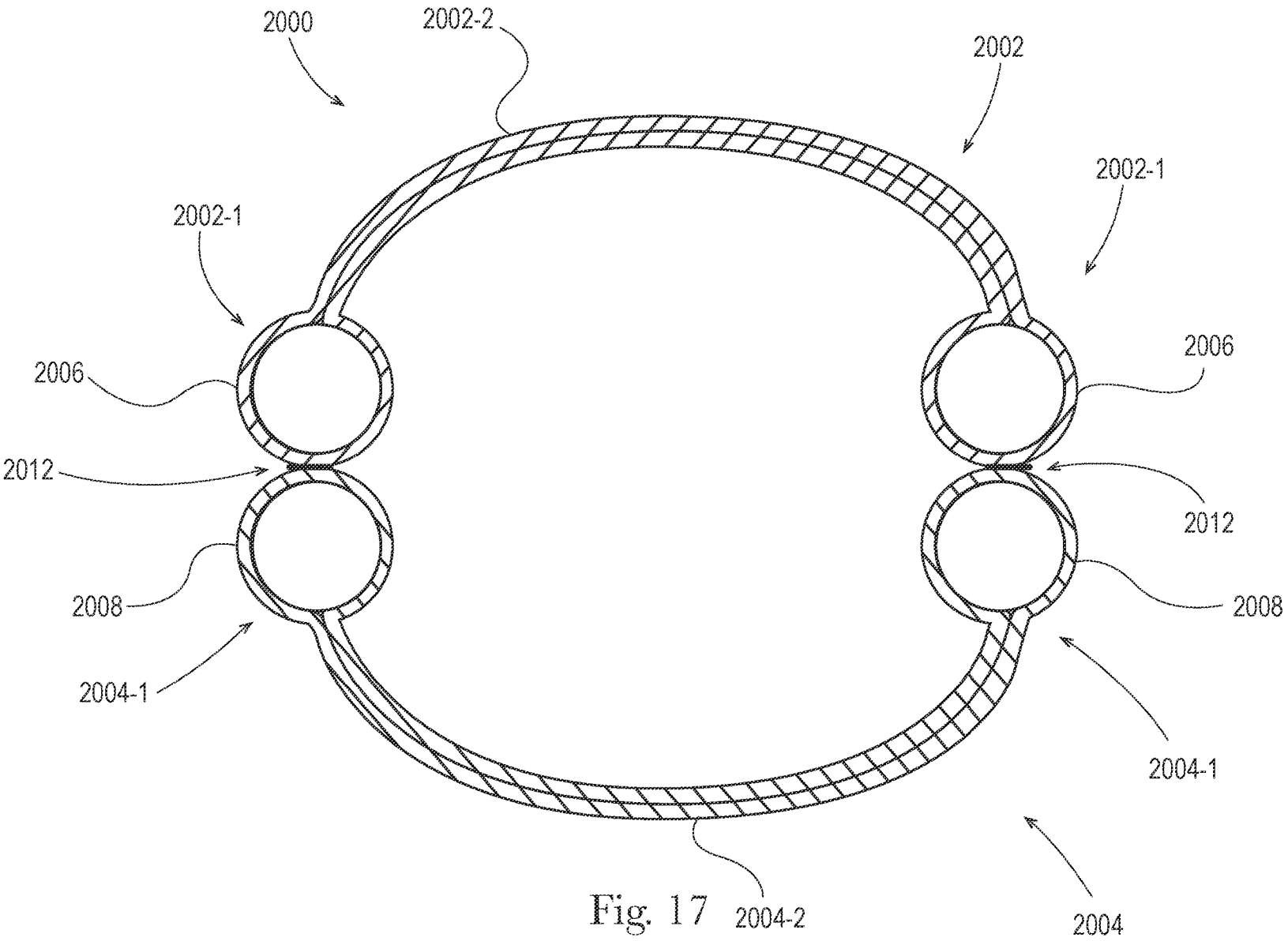
FIG. 17 illustrates a cross-sectional view of a container having reduced tension in the first and second film walls in accordance with yet another embodiment of the disclosure.

Referring to FIGS. 15-17, in accordance with embodiments of the disclosure, the container can include first and second structural support members 2006, 2008, with the first structural support member 2006 being defined in a first wall 2002 of the container and the second structural support member 2008 being defined in a second wall 2004 of the container. The first and second structural support members 2006, 2008 are adjacent to each other when expanded in at least the seam region of the container. For example, the first and second structural support members 2006, 2008 when in an expanded state can overlap and/or adjoin in at least the seam region. In an embodiment, the first and second structural support members 2006, 2008 are adjacent to each either along an entire length of the container. In an embodiment, the first and second structural support members 2006, 2008 are in contact with one another along an entire length of the container.

The first and/or second structural support members 2006, 2008 can have widths (in an unexpanded state) that are the same, partially the same, or different. For example, in an embodiment, portions of one or more of the structural support members 2006, 2008 can have widths that are the same, while other portions of the structural support members 2006, 2008 have different widths. Any of the structural support members can have uniform widths along a length of the container or can have widths that vary. For example, in an embodiment, one or both of the first and second structural support members 2006, 2008 can have a uniform width in the seam region. Alternatively, one or both of the first and second structural support members 2006, 2008 can have a width that varies in the seam region.

Referring to FIG. 15, the container includes first and second boundaries 2048, 2050 of the first structural support member 2006. A first joined region, for example, at least one seal, can define a first boundary of the first structural support member 2006. The seam 2012 can define a second boundary 2050 of the first structural support member 2006. The first boundary 2048 is inboard of the second boundary 2050. The width of the first joined region can be different than the width of the seam 2012 and can be formed by the same or a different sealing method. For example, the first joined region can be wider than the seam. Similarly, the second structural support member 2008 can be defined by a first boundary 2048 inboard of a second boundary with the seam 2012 defining the second boundary 2050. Thus, in some embodiments, the seam 2012 can serve to define a second (outboard) boundary of the first and second structural support members 2006, 2008. The seam 2012 can further define a boundary of the product volume. In other embodiments, separate joined regions can be used to define the second (outboard) boundaries of the first and/or second structural support members 2006, 2008. The joined regions can be joined together to form the seam and define a boundary of the product volume. In some embodiments, the seam can be formed outboard of the second (outboard) boundaries of the first and/or second structural support members. The seam 2012 is defined by the joining of the first and second film walls at the intersection 2052 of the first and second walls and projects from this intersection 2052 to a free end 2054.

The seam can extend along a bottom region of the container and can contact a horizontal support surface when the container is standing upright on the horizontal support surface. In another embodiment, a seam, either connected to or separate from a seam along a side edge of the container can extend around a bottom of the container to contact the horizontal support surface when the container is standing upright on the horizontal support surface. In other embodiments, the seam or seams can be arranged so as to avoid contact with the horizontal support surface.

In accordance with an embodiment of the disclosure, a seam 2012 in at least a portion of the container 2000 can be effectively reduced such that the user's hand does not contact a seam 2012 when handling the container 2000. As used herein, the term "effectively reduced" refers to a seam 2012 that has an actual reduction in width or made non-detectable to a user by one or more features of the container. All or only a portion of the seam(s) 2012 included on the containers can be effectively reduced. For example, the seam can be effectively reduced in a gripping region of the container 2000. Other regions of the container 2000, including the top, middle, and bottom regions, can also include seams 2012 that are effectively reduced.

Figure 19:
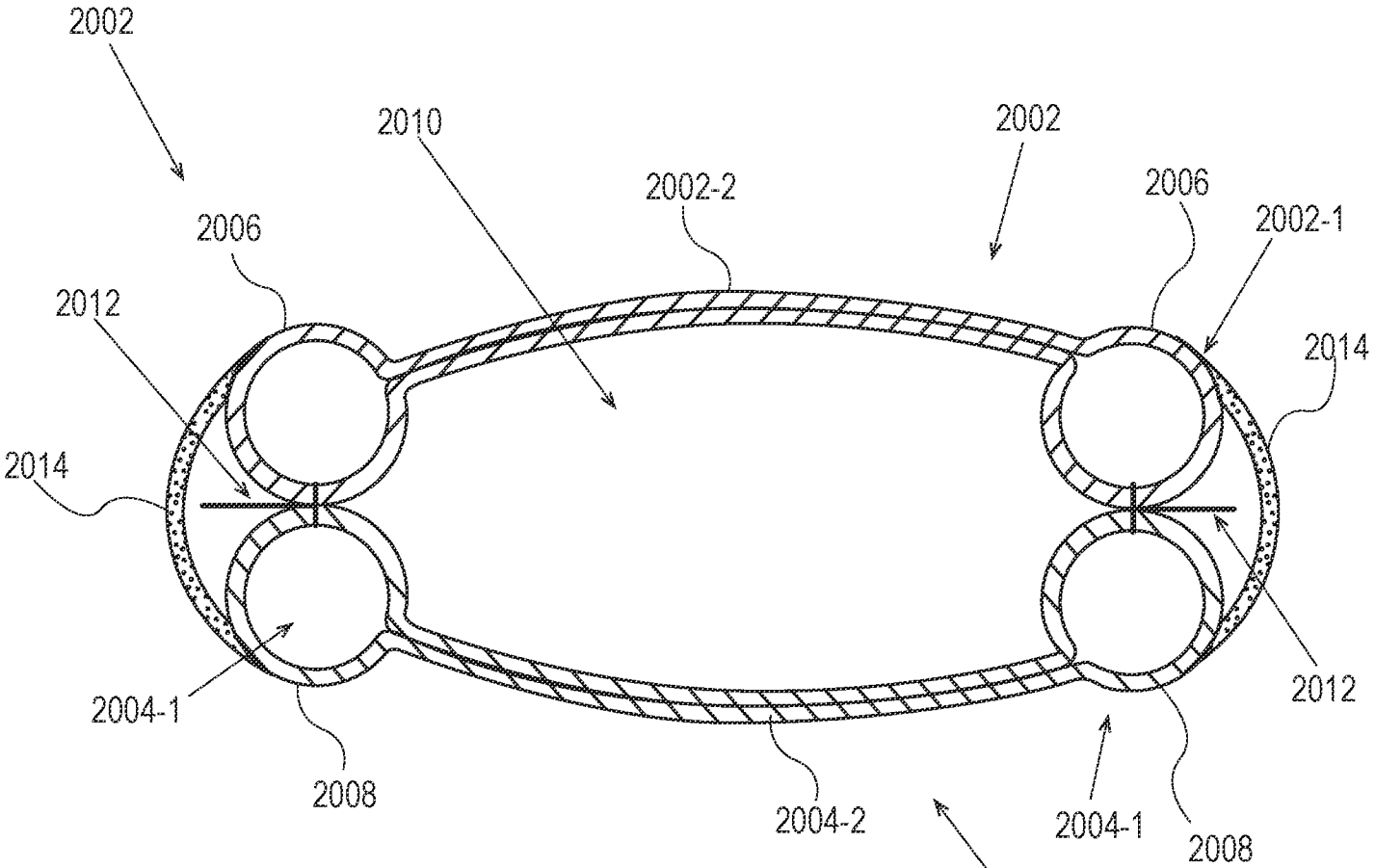
FIG. 19 illustrates a cross-sectional view of a container having a cover material in accordance with an embodiment of the disclosure.
Figure 20:
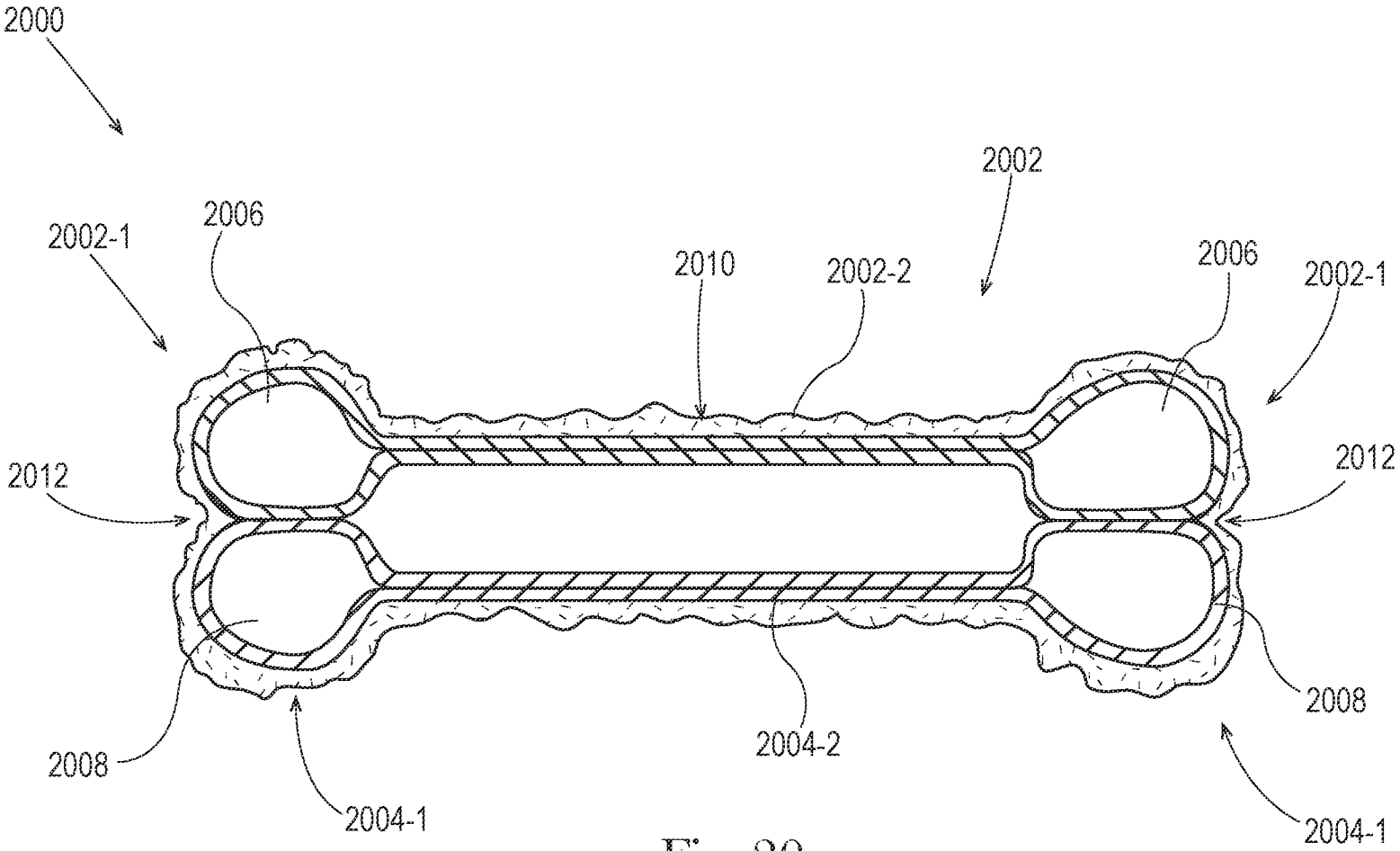
FIG. 20 illustrates a cross-sectional view of a container having a cover material disposed over the entire container in accordance with another embodiment of the disclosure.

For example, an actual reduction of the seam 2012 can be achieved by trimming the seam during formation of the container. Referring to FIGS. 19 and 20, for example, a cover material 2014 can be provided over all or a portion of the container to cover a seam 2012 and thereby render the seam undetectable by a user. FIG. 19 illustrates an embodiment in which the cover material 2014 is joined to the first and second structural support members 2006, 2008, covering the seam 2012. FIG. 20 illustrate an embodiment in which the cover material 2014 covers the entire outer surface of the container 2000. Referring to FIG. 17, a seam 2012 can be effective reduced by providing portions of the container 2000, such as a structural support member 2006, 2008, which extend beyond the side of the seam 2012 having the furthest projection from the intersection 2052 of the first and second film walls, such that the user's hand contacts the structural support member 2006, 2008 as opposed to the seam 2012. In FIG. 15, for example, the side of the seam having the furthest projection from the intersection 2052 of the first and second film walls is the free end 2054. In FIG. 21, the side of the seam having the furthest projection from the intersection 2052 of the first and second film walls is illustrated at reference number 2053. Referring to FIG. 18, in an alternative embodiment, a seam 2012 can be effectively reduced by at least partially forming the container blank including the joining portion which defines the seam 2012 and inverting the container blank such that the seam 2012 extend inwardly from the seam region as opposed to outwardly from the seam region. In another embodiment, the seam 2012 can be effectively reduced by joining the seam to a portion of a structural support member, which can thereby render the seam 2012 less obtrusive or undetectable by a user handling the container.

It has been advantageously recognized that the structural support members of the container can be used to effective reduce the width of a seam. For example, the seam width and the width of the structural support members can be dimensioned such that the structural support members extend past the side of the of the seam having the furthest projection from the intersection 2052 of the first and second film walls, thereby preventing interaction of the user's hand with the seam. The degree to which the structural support members can effectively reduce the width of the seam can be varied not only based on the ratio of the width of the structural support member to the width of the seam, but also by the amount of tension in a panel of the first and/or second wall disposed adjacent the structural support members. For example, referring to FIGS. 15-17, increased tension in the panel or panels adjacent the structural support member increase can cause the seam disposed between the adjacent structural support members to protrude outwardly. Referring to FIGS. 15 and 16, as the tension in the panel or panels is reduced (as illustrated in FIG. 17), the structural support members 2006, 2008 will rotate outwardly, thereby recessing the seam 2012 to between the adjacent structural support members 2006, 2008. Referring to FIG. 16, as tension in the panel or panels is increase, the structural support members 2006, 2008 will rotate inwardly, thereby increasing the extent to which the seam 2012 extends from the seam region.

Figure 21A:
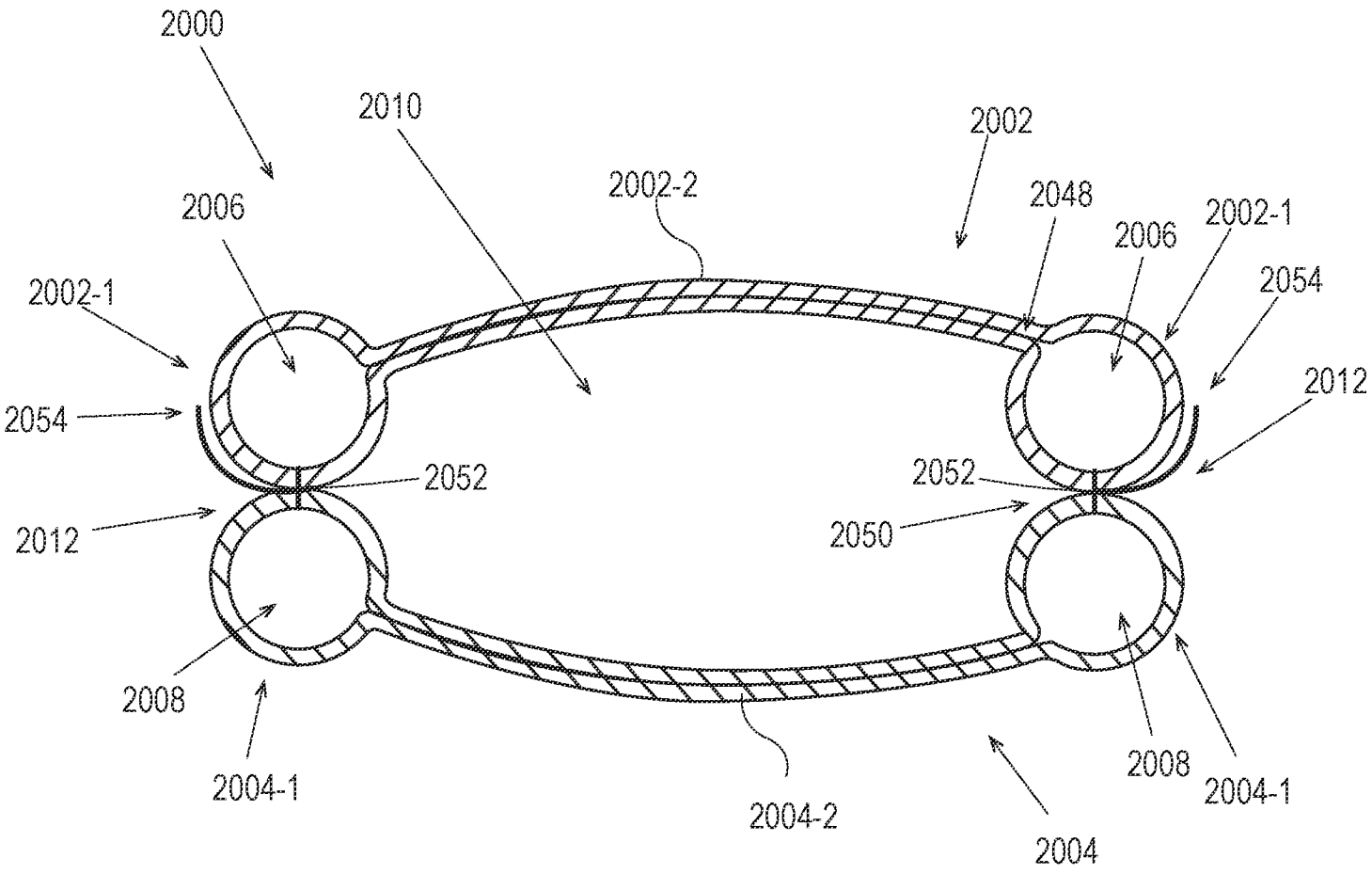
FIGS. 21A-21E illustrate cross-sectional views of containers having various seam orientations in accordance with embodiments of the disclosure.
Figure 21B:
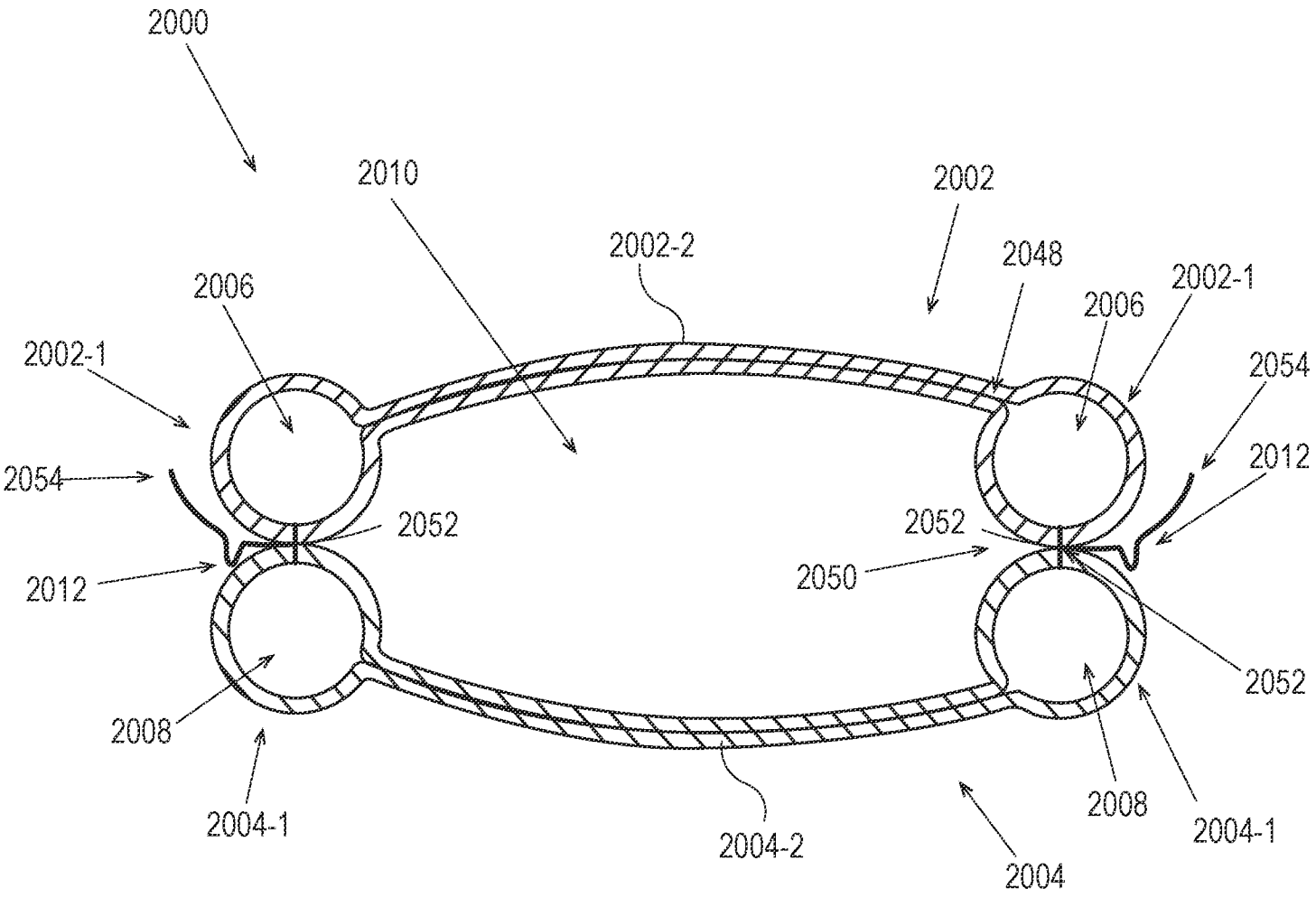
Figure 21C:
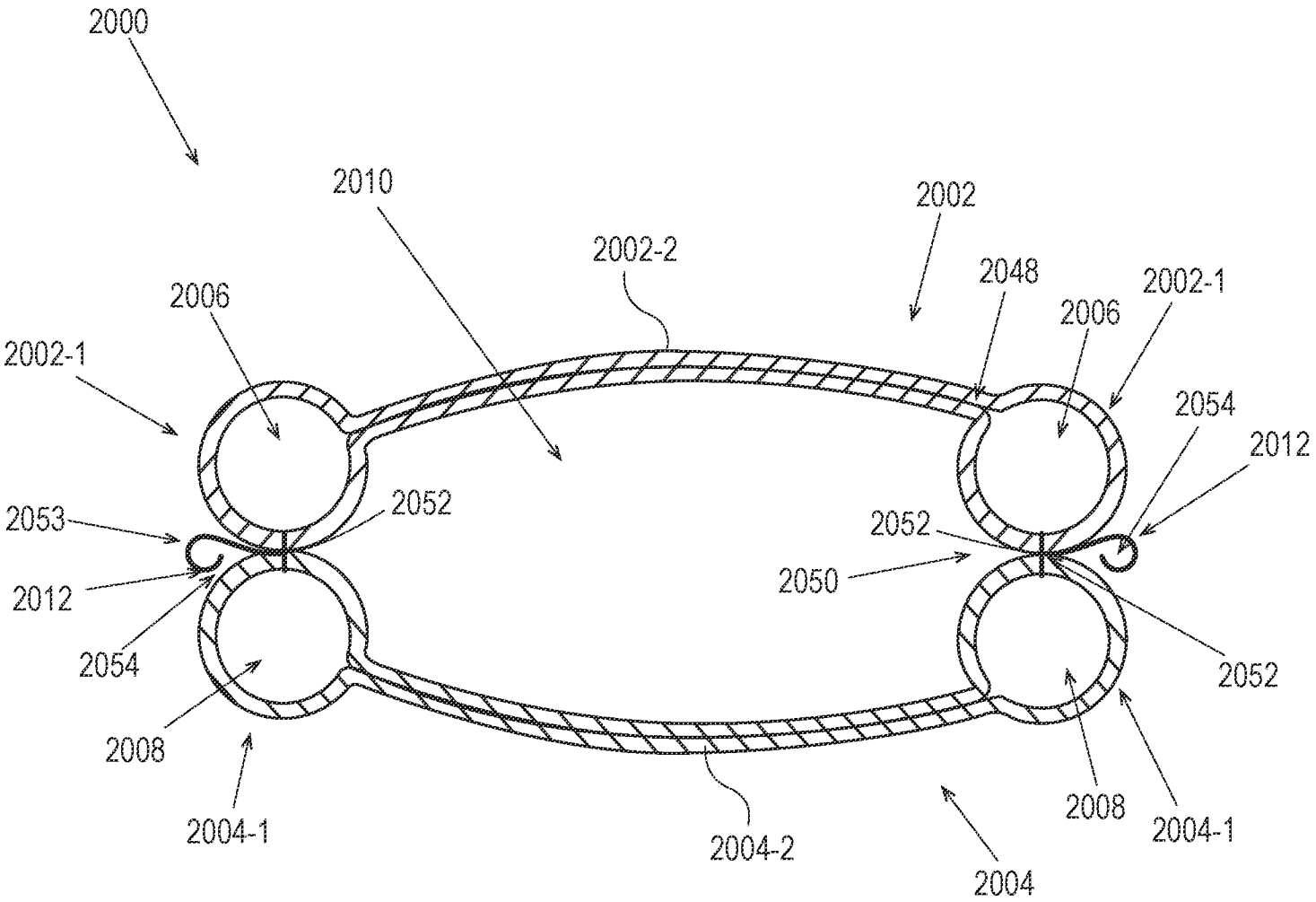
Figure 21D:
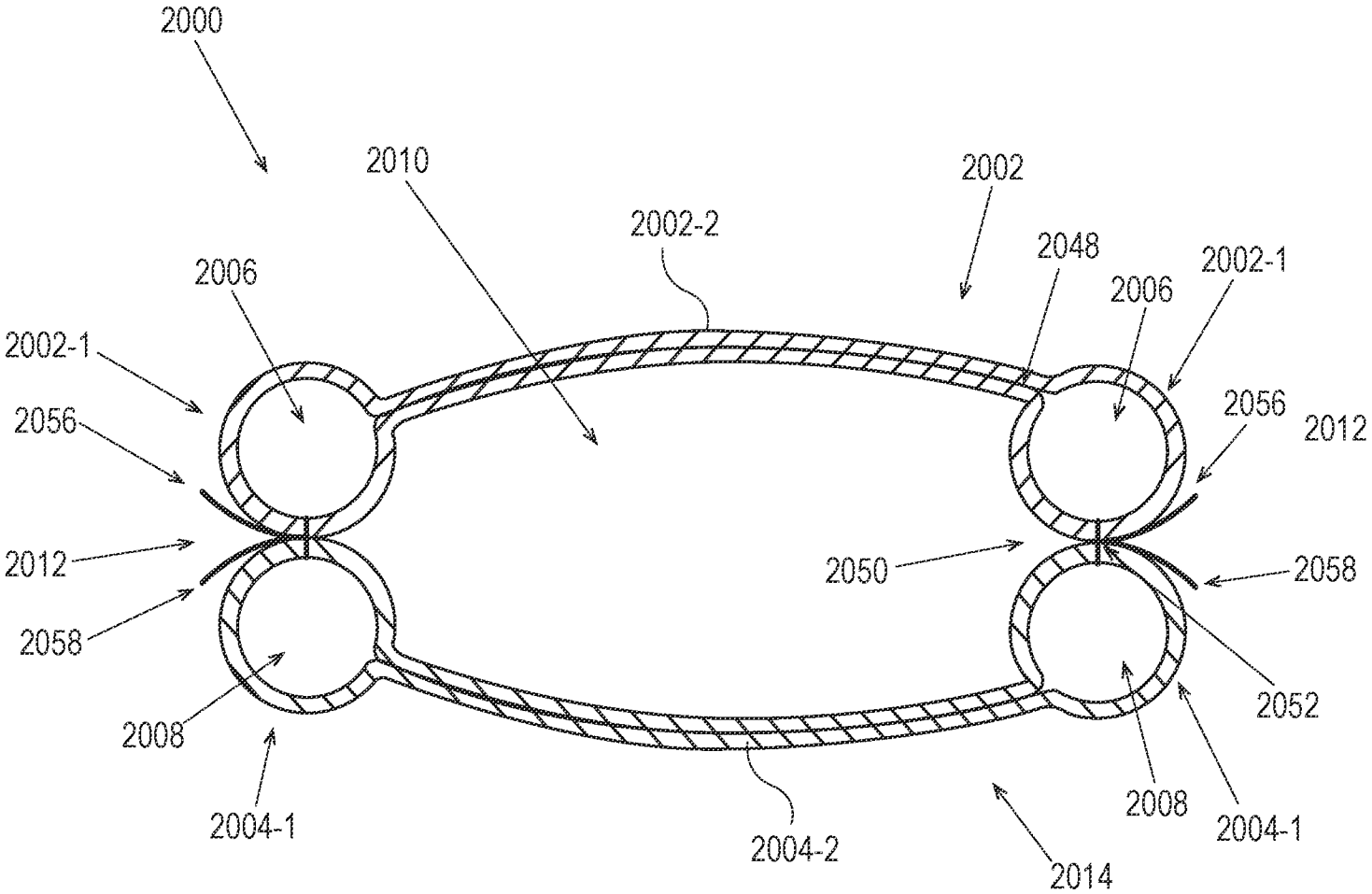
Figure 21E:
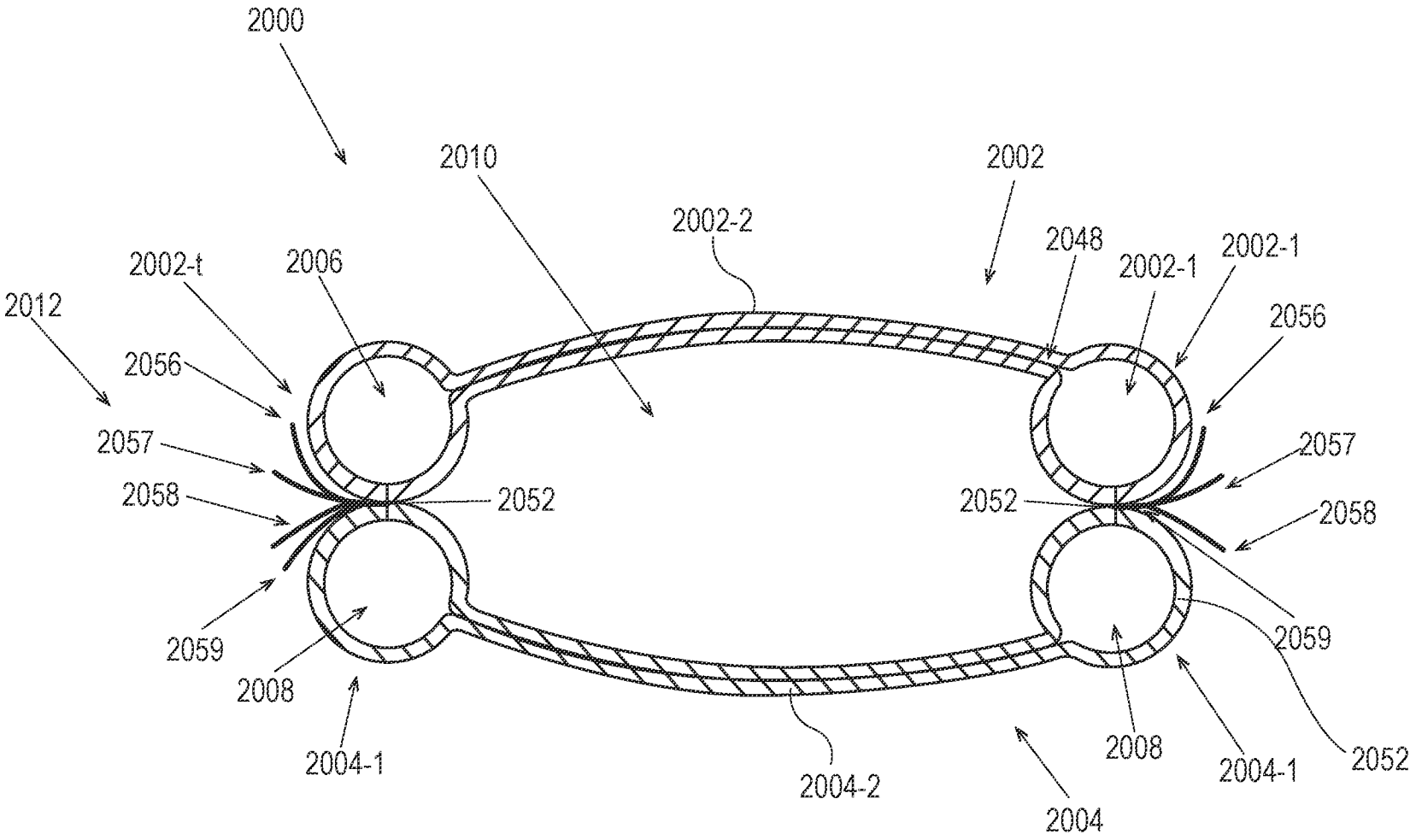

Referring to FIGS. 21A-21E, as noted above, the seam can have a linear, curvilinear, curled, or any other suitable orientation. The seam can also include a first seam portion in which the flexible materials of the first and second film wall are joined and a second seam portion in which all or a portion the flexible materials of the first and second film walls remain unjoined. FIG. 21A illustrates an embodiment in which the seam can curve along a path such that it is generally consistent with the curvature of one of the structural support members when in the expanded state. FIG. 21B illustrates an embodiment in which the seam includes a curved, angled, and linear segment portions. FIG. 21C illustrates an embodiment in which the seam is curled such that the seam projects outwardly from the intersection 2052 of the first and second film walls and then curls back such that the free end 2054 returns back towards the intersection 2052 of the first and second film walls. FIG. 21D illustrates an embodiment in which two flexible materials 2056, 2058 are unjoined in a second seam portion and not in a co-facial relationship. FIG. 21E illustrates an embodiment in which four flexible materials 2056, 2057, 2058, 2059 are unjoined in a second seam portion and not in a co-facial relationship.

It should be understood herein that each of the first and second film walls can be formed of any suitable number of flexible materials and second seam portion of the seam can include all or a subset of the flexible materials in a single orientation or each of the flexible materials can be provided in different orientations. Referring to FIG. 21E, for example, in an embodiment, the seam can be formed by joining four flexible materials in a first seam portion adjacent the intersection 2052 of the first and second film walls, with all four flexible materials remaining unjoined in a second seam portion adjacent the free end 2054. The unjoined flexible materials can each have the same orientation so as to be all co-facial, each have different orientations, such that each is non-co-facial with an adjacent flexible material, or can have a subset of flexible materials in the same orientation and a subset in a different orientation. Alternatively the second seam portion can include a subset of the flexible materials, which are joined and a subset that remain unjoined. Referring to FIG. 21D, for example, in the embodiment in which each of the first and second film walls can include two flexible materials, such that the seam includes the joining of four flexible materials (i.e., joining of the first and second film walls) in the first seam portion. The second seam portion of the seam can include, for example, two non-joined portions defined by the first and second film walls. For example, the two flexible materials of the first film wall remain joined along an entire width of the seam and the two flexible materials of the second film wall remain joined along en entire width of the seam, but the first and second film walls remained unjoined in the second seam portion. Alternative joining and non-joining arrangements are also contemplated as any one or subset of flexible materials can be included in second seam portion as desired.

Figure 22:
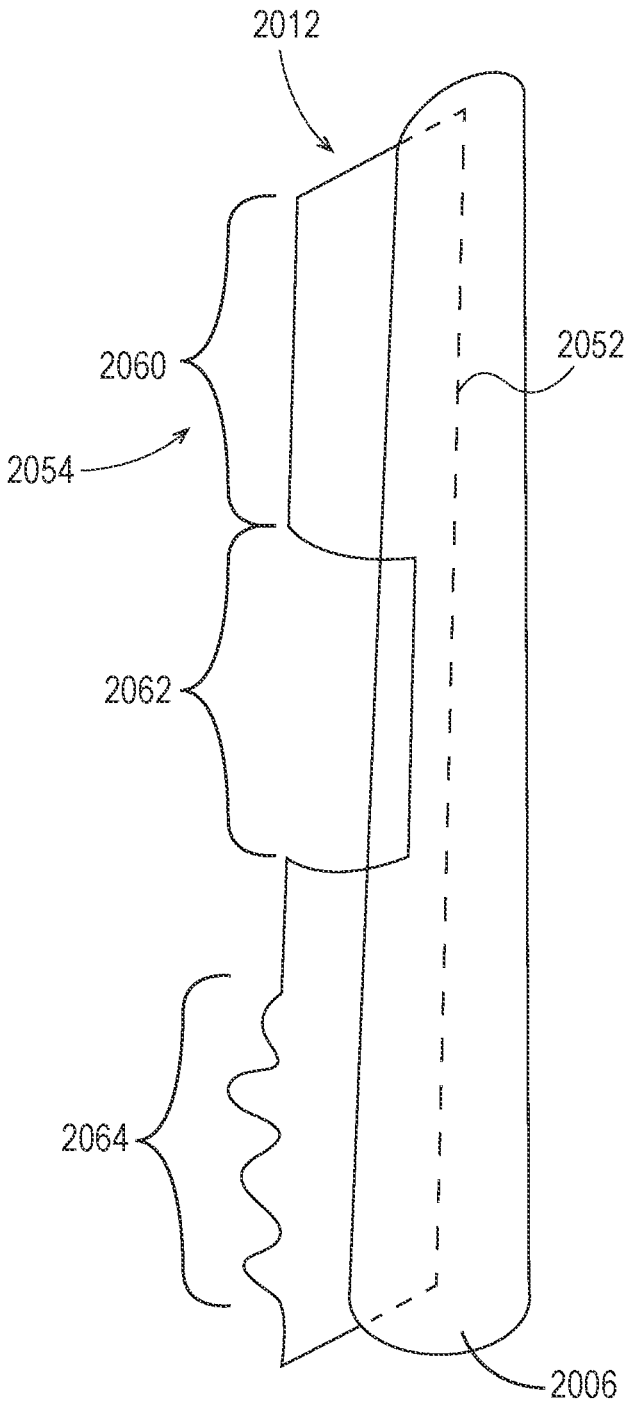
FIG. 22 is a perspective view of a seam having varying orientation and seam profiles in accordance with embodiments of the disclosure.

As noted above, the seam can vary in orientation, width, profile, and/or pattern along all or a portion of the seam length. Alternatively, the seam can be uniform in one or more aspects or all aspects along the seam length. FIG. 22 is a perspective view of a seam having varying profile shape and orientation along the length of the seam. In particular, FIG. 22 illustrates a first region 2060 of the seam having a linear seam profile, a second region 2062 of the seam having a linear seam profile and being angled towards one of the structural support members, a third region 2064 having a non-linear seam profile and particularly a wavy or curved seam profile. The undulations of the curved seam profile can have the same or different peak and/or valley widths and/or heights.

In an embodiment, the first and second walls can be integral with one another along at least one edge of the container. Such an embodiment can present a gripping region having no seam. In various embodiments, at least portion of the seam 2012 can extend from the seam region with a width sufficient to allow contact of the seam 2012 by the user when handling the container. The seam 2012 can include a profile having any suitable shape. The seam can also include decorative embellishments and/or cuts into the seam inboard of the seam profile. The profile of the seam 2012, decorative embellishments, and/or cuts into the seam inboard of the seam profile can be used to convey information to the user about the product contained in the product volume. For example, one or more of the seam profile, decorative embellishments, and cuts into the seam can convey information to the user in a visual and/or tactile manner. For example, in accordance with an embodiment, a container shelf set can include first and second flexible containers each having at least a portion of a seam 2012 extending outwardly from the seam region so as to be contactable by the user. The seam of the first container can have a different profile than the seam of the second container, which can convey to the user information about the contents of the shelf set. For example, the first container can contain shampoo and have a seam profile of a first shape, while the second container can contain conditioner and have a seam profile of a second shape. In such an exemplary embodiment, the seam profile designates to the user which product is shampoo and which is conditioner. Other types of product sets can similarly be provided in container shelf sets with containers having different seam profiles to designate information about the product. The seam profile can also provide information about a product in a single container, a particular variant of product, or family of products, and is not limited to use in a self set. Decorative embellishments, and/or into the seam can similarly provide information about a product in a shelf set or in a single container.

Figure 23:
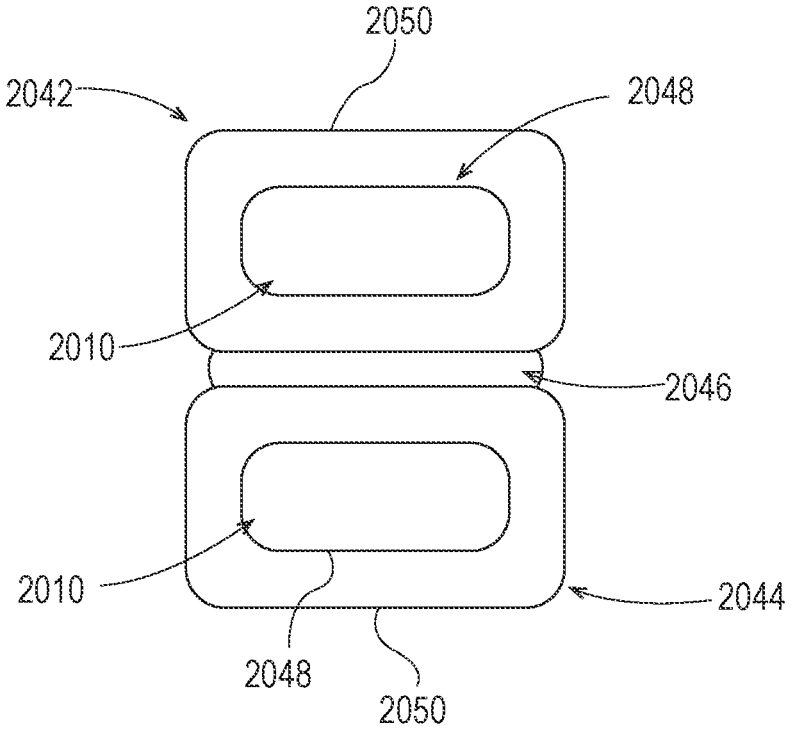
FIG. 23 illustrates a flexible material having two container blanks joined by a seam at an edge in accordance with an embodiment of the disclosure.

Referring to FIG. 23, a container blank system 2040 can include a plurality of container blanks. For simplicity only two container blanks 2042, 2044 are illustrated in FIG. 23. Any suitable number of container blanks can be provided in the container blank system 2040. Adjacent container blanks 2042, 2044 are joined by a seam 2046. When the container blanks are separated for forming the container, the seam 2046 can be cut such that each container blank retains a portion of the seam 2046. The container blank includes a first joined region defining an inboard boundary 2048 of a structural support member and an outboard boundary 2050 defining a boundary of the product volume. A portion of the outboard boundary defining the product volume 2010 can be provided by the seam.

A method of making a non-durable flexible container can include providing a first flexible material comprising first and second sealable layers and providing a second flexible material comprising a third sealable layer. The method can further include joining a portion of the first sealable layer to a portion of the third sealable layer in a first region of the first and second flexible materials with at least one seal to define an inner boundary of a first structural support member, wherein the first structural support member is defined in a first portion of the first region and a second portion of the first region is free of a structural support member. The method can also include joining a portion of the first sealable layer to a portion of the third sealable layer in a second region of the first and second materials with at least one seal to define an inner boundary of the second structural support member. The inner boundary of the first and second structural support volumes can be defined at substantially the same or different times. The method can also include joining a portion of the second sealable layer in the first region and a portion of the second sealable layer in the second region with at least one seal to define an outer boundary of a product volume and a seam that outwardly projects from an edge of the non-durable flexible container. Joining the second sealable layer in the first region to the second sealable layer in the second region can also be used to define an outer boundary of the first and second structural support members. Alternatively, the outer boundary of the first and second structural support members can be defined by separately joining portions of the first and third sealable layers. The at least one seal joining portions of the first and third sealable layers in the first and second regions can formed by a different or the same sealing method as the at least one seal joining the portion of the second sealable layer in the first region to the portion of the second sealable layer in the second region.

The method can further include trimming the seam. For example, the seam can be formed and trimmed in a single operation or in sequential operations. Examples of methods to form and trim or trim after forming the seams include: cutting by hand, hot wire sealing, cut sealing, ultrasonic cut sealing, die cutting, laser cutting, water jet cutting, and air knife cutting. The method can also further include inverting the film after at least partially forming the seam such that the seam projects inwardly into the product volume once the film is inverted.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: (1) U.S. non-provisional application Ser. No. 13/888,679 filed May 7, 2013, entitled "Flexible Containers" and published as US20130292353 (applicant's case 12464M); (2) U.S. non-provisional application Ser. No. 13/888,721 filed May 7, 2013, entitled "Flexible Containers" and published as US20130292395 (applicant's case 12464M2); (3) U.S. non-provisional application Ser. No. 13/888,963 filed May 7, 2013, entitled "Flexible Containers" published as US20130292415 (applicant's case 12465M); (4) U.S. non-provisional application Ser. No. 13/888,756 May 7, 2013, entitled "Flexible Containers Having a Decoration Panel" published as US20130292287 (applicant's case 12559M); (5) U.S. non-provisional application Ser. No. 13/957,158 filed Aug. 1, 2013, entitled "Methods of Making Flexible Containers" published as US20140033654 (applicant's case 12559M); and (6) U.S. non-provisional application Ser. No. 13/957,187 filed Aug. 1, 2013, entitled "Methods of Making Flexible Containers" published as US20140033655 (applicant's case 12579M2); (7) U.S. non-provisional application Ser. No. 13/889,000 filed May 7, 2013, entitled "Flexible Containers with Multiple Product Volumes" published as US20130292413 (applicant's case 12785M); (8) U.S. non-provisional application Ser. No. 13/889,061 filed May 7, 2013, entitled "Flexible Materials for Flexible Containers" published as US20130337244 (applicant's case 12786M); (9) U.S. non-provisional application Ser. No. 13/889,090 filed May 7, 2013, entitled "Flexible Materials for Flexible Containers" published as US20130294711 (applicant's case 12786M2); (10) U.S. provisional application 61/861,100 filed Aug. 1, 2013, entitled "Disposable Flexible Containers having Surface Elements" (applicant's case 13016P); (11) U.S. provisional application 61/861,106 filed Aug. 1, 2013, entitled "Flexible Containers having Improved Seam and Methods of Making the Same" (applicant's case 13017P); (12) U.S. provisional application 61/861,118 filed Aug. 1, 2013, entitled "Methods of Forming a Flexible Container" (applicant's case 13018P); (13) U.S. provisional application 61/861,129 filed Aug. 1, 2013, entitled "Enhancements to Tactile Interaction with Film Walled Packaging Having Air Filled Structural Support Volumes" (applicant's case 13019P); (14) Chinese patent application CN2013/085045 filed Oct. 11, 2013, entitled "Flexible Containers Having a Squeeze Panel" (applicant's case 13036); (15) Chinese patent application CN2013/085065 filed Oct. 11, 2013, entitled "Stable Flexible Containers" (applicant's case 13037); (16) U.S. provisional application 61/900,450 filed Nov. 6, 2013, entitled "Flexible Containers and Methods of Forming the Same" (applicant's case 13126P); (17) U.S. provisional application 61/900,488 filed Nov. 6, 2013, entitled "Easy to Empty Flexible Containers" (applicant's case 13127P); (18) U.S. provisional application 61/900,501 filed Nov. 6, 2013, entitled "Containers Having a Product Volume and a Stand-Off Structure Coupled Thereto" (applicant's case 13128P); (19) U.S. provisional application 61/900,508 filed Nov. 6, 2013, entitled "Flexible Containers Having Flexible Valves" (applicant's case 13129P); (20) U.S. provisional application 61/900,514 filed Nov. 6, 2013, entitled "Flexible Containers with Vent Systems" (applicant's case 13130P); (21) U.S. provisional application 61/900,765 filed Nov. 6, 2013, entitled "Flexible Containers for use with Short Shelf-Life Products and Methods for Accelerating Distribution of Flexible Containers" (applicant's case 13131P); (22) U.S. provisional application 61/900,794 filed Nov. 6, 2013, entitled "Flexible Containers and Methods of Forming the Same" (applicant's case 13132P); (23) U.S. provisional application 61/900,805 filed Nov. 6, 2013, entitled "Flexible Containers and Methods of Making the Same" (applicant's case 13133P); (24) U.S. provisional application 61/900,810 filed Nov. 6, 2013, entitled "Flexible Containers and Methods of Making the Same" (applicant's case 13134P); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment.

Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of making a stand up non-durable flexible container comprising:

providing a first flexible material comprising first and second sealable layers;

providing a second flexible material comprising a third sealable layer;

joining a portion of the first sealable layer to a portion of the third sealable layer in a first region of the first and second flexible materials with at least one seal to provide a first film wall, the at least one seal defining an inner boundary of a first structural support member, wherein the first structural support member is defined in the first film wall and a second portion of the first region is a panel that is free of a structural support member;

joining a portion of the first sealable layer to a portion of the third sealable layer in a second region of the first film wall with at least one seal to define an inner boundary of a second structural support member, wherein the panel is provided between the first structural support member and the second structural support member;

joining a portion of the second sealable layer in the first region with at least one seal to define an outer boundary of a product volume and a base;

joining the first wall and the second wall with at least one seal to define a seam region that outwardly projects from an edge of the non-durable flexible container; and trimming the seam to form a stand up non-durable flexible container comprising a first film wall comprising a first structural support member, a second structural support member, and a panel that is free of a structural support member provided between the first structural support member and the second structural support member, a second film wall opposite the first film wall, a seam that defines an edge of the non-durable flexible container; a product volume for containing one or more fluent products, wherein the product volume is disposed between the first film wall and the second film wall, and a base, wherein the product is configured so that the base of the container rests on a horizontal surface;

inflating the first and second structural support members wherein the in the seam region is at least partially recessed between adjacent structural support members.

2. The method of claim 1 wherein the joining of a portion of the first sealable layer to a portion of the third sealable layer in the first region and the second region of the first and second flexible materials to define the inner boundary of the first and second structural support members, respectively, occurs at the same time.

3. The method of claim 1 wherein the step of trimming the seam comprises trimming the seam by laser cutting.

4. The method of claim 3 wherein the seam is trimmed to a width of between about 0.1 mm to about 5 mm.

5. The method of claim 1 wherein the first flexible material and the second flexible material comprise a container blank system that includes a plurality of container blanks wherein adjacent container blanks are joined together.

6. The method of claim 5 wherein adjacent container blanks are separated for forming the containers.

7. The method of claim 6 wherein the container blanks are configured so that the containers have sides, wherein at least a portion of the sides are curvilinear.

8. The method of claim 7 wherein at least a portion of the seam along the sides of the container blanks is curved.

9. The method of claim 6 wherein the step of trimming the seam comprises trimming the seam by laser cutting.

* * * * *